US008240795B2

(12) United States Patent
Baba

(10) Patent No.: US 8,240,795 B2
(45) Date of Patent: Aug. 14, 2012

(54) PRINTING METHOD AND PRINTING APPARATUS

(75) Inventor: Naoko Baba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1029 days.

(21) Appl. No.: 12/174,300

(22) Filed: Jul. 16, 2008

(65) Prior Publication Data

US 2009/0021543 A1 Jan. 22, 2009

(30) Foreign Application Priority Data

Jul. 18, 2007 (JP) ..... 2007-187394

(51) Int. Cl.
*B41J 29/38* (2006.01)

(52) U.S. Cl. ..... 347/9; 347/5; 347/6; 347/7; 347/8; 347/10; 347/11; 347/12; 347/13; 347/14; 347/15; 347/16; 347/17; 347/18; 347/19

(58) Field of Classification Search ..... 347/5–19
See application file for complete search history.

(56) References Cited

U.S. PATENT DOCUMENTS

| | | | | |
|---|---|---|---|---|
| 5,262,872 | A * | 11/1993 | Yoshimura et al. | 358/296 |
| 5,969,730 | A * | 10/1999 | Inose et al. | 347/14 |
| 6,068,359 | A * | 5/2000 | Inose et al. | 347/5 |
| 6,068,365 | A | 5/2000 | Nagoshi et al. | |
| 6,398,358 | B1 | 6/2002 | Miyake et al. | |
| 6,908,173 | B2 * | 6/2005 | Otsuki et al. | 347/19 |
| 2004/0080555 | A1 * | 4/2004 | Otsuki et al. | 347/14 |
| 2005/0057600 | A1 * | 3/2005 | Teshigawara et al. | 347/19 |
| 2007/0008370 | A1 * | 1/2007 | Kawatoko et al. | 347/19 |
| 2007/0013726 | A1 * | 1/2007 | Hayashi et al. | 347/5 |
| 2007/0296752 | A1 * | 12/2007 | Maruo et al. | 347/19 |
| 2009/0021543 | A1 * | 1/2009 | Baba | 347/9 |

FOREIGN PATENT DOCUMENTS

| | | |
|---|---|---|
| JP | 5-104739 | 4/1993 |
| JP | 6-31909 | 2/1994 |

* cited by examiner

*Primary Examiner* — Ryan Lepisto
*Assistant Examiner* — Guy Anderson
(74) *Attorney, Agent, or Firm* — Fitzpatrick, Cella, Harper & Scinto

(57) ABSTRACT

A printing method and a printing apparatus of the present invention are capable of performing both a vertical registration adjustment in which a range of nozzles used for printing is limited and a vertical registration adjustment in which print data is shifted. More specifically, switching is performed between the vertical registration adjustment in which a range of nozzles used for printing is limited and the vertical registration adjustment in which print data is shifted, in accordance with conditions such as a printing mode, types of printing medium, and the like. Thereby, an improvement of a throughput by a printing apparatus and an improvement of an image quality printed by the printing apparatus can be together achieved.

16 Claims, 23 Drawing Sheets

PRINTING METHOD AND PRINTING APPARATUS

BACKGROUND OF THE INVENTION

1. Field of the Invention

The present invention relates to a printing method and a printing apparatus, and more particularly to a printing position adjustment for each of the printing elements arranged in a print head, which is performed in generating the print data.

2. Description of the Related Art

As an information output apparatus for a personal computer, a word processor or a facsimile, a printing apparatus such as a printer for printing information such as character or image on a printing medium such as paper or film-like sheet is widely employed. Though various printing methods for the printing apparatus are well known, an ink jet method has been widely employed in recent years because of the capability of non-contact printing on the printing medium such as paper, easy colorization, and low noise. In the ink jet printing apparatus, a serial printing method is generally employed in which a print head for ejecting ink is mounted on a carriage and the printing is performed while reciprocating the print head for a scan of the print head in a direction (hereinafter referred to as a main scanning direction) intersecting with a conveying direction of the printing medium.

In the serial method, a so-called bidirectional printing is performed in which the printing is performed by ejecting the ink from the print head in both forward and backward paths in moving the carriage on the printing medium, whereby the printing rate can be improved. Also, the printing rate can be improved by increasing the number of ink ejection openings (also called nozzles) arranged in the print head.

Meanwhile, there is conventionally a well-known problem of a misalignment of print positions which is caused by positions of ejection openings for respective kinds or colors of ink in a print head being displaced from each other. Particularly, this problem is more remarkable as the number of ejection openings arranged is increased as described above.

FIGS. 1A to 1C are views explaining displacements of nozzle between a plurality of print heads. These figures show the examples of respective print heads for ejecting respective color inks of K (black), C (cyan), M (magenta) and Y (yellow). FIG. 1A shows an example of a head arrangement in which the print heads for respective color inks have the same length (nozzle array length), and the respective print heads are arranged in the main scanning direction. Also, FIG. 1B shows an example of a head arrangement in which a part of the print heads for respective color inks has a different length, and the print heads are arranged in the main scanning direction. Further, FIG. 1C shows a head arrangement in which a part of the respective print heads for respective color inks has similarly a different length, and the print heads are arranged in the direction orthogonal to the main scanning direction.

Herein, if the positional relationship of corresponding nozzles between the color print heads is correct, inks ejected from the respective nozzles can form a correct positional relation on the printing medium to contribute to printing of a desired image. However, the correct positional relationship of nozzles may not be realized depending on the degree of precision of the print head in a manufacturing process or the degree of precision of mounting the print head on the printing apparatus. For example, in the head arrangement as shown in FIG. 1A, the C print head is displaced one nozzle downward, the M print head is displaced two nozzles upward, and the Y print head is displaced one nozzle upward, relative to the K head.

FIG. 2 is a view showing one example of the printed result using all the nozzles of the print head as shown in FIG. 1A. As shown in FIG. 2, a print area A101 is printed with M ink only, a print area A102 is printed with M and Y ink, a print area A103 is printed with K, M and Y inks, a print area A104 is printed with K, C and Y inks, a print area A105 is printed with K and C inks, and a print area A106 is printed with C ink only.

To reduce degraded image quality due to printing misalignment in a conveying direction (sub-scanning direction) of the printing medium, an adjustment (hereinafter called a vertical registration adjustment) of adjusting the printing position of the print head for each color is conventionally performed. The conventional vertical registration adjustments are well known in which nozzles used for printing are limited, a preset nozzle used for the vertical registration adjustment is employed, and print data is shifted according to an amount of misalignment in the printing position (e.g., refer to Japanese Patent Laid Open No. 5-104739 (1993) and Japanese Patent Laid Open No. 6-031909 (1994)).

However, in conventional printing apparatus that performs the vertical registration adjustment, the adjustment is performed by one of two methods: a method of limiting nozzles used for printing to perform the adjustment and a method of shifting print data to perform the adjustment.

In the case of limiting nozzles used for printing to perform the adjustment, since the nozzles used for printing are limited, a problem that a throughput by a printing apparatus is decreased may occur. On the other hand, in the vertical registration adjustment method of shifting the print data, when print data resolution is lower than nozzle resolution (a nozzle pitch), the vertical registration adjustment can be performed only at resolution lower than the nozzle resolution and therefore the deterioration of a printed image quality may occur.

Consequently, in the printing apparatus in which the vertical registration adjustment is performed in a condition that a range of nozzles used for printing is limited, printing is always performed with use of a limited number of nozzles and therefore a desired throughput may not be achieved. On the other hand, in the printing apparatus employing the vertical registration adjustment of shifting print data, when the print data resolution is lower than the nozzle resolution, the vertical registration adjustment can not be properly performed and therefore an image of desired print quality may not be obtained, regardless of how printing of high quality printed image is desired.

SUMMARY OF THE INVENTION

An object of the present invention is to provide a printing method and a printing apparatus that are capable of performing both a vertical registration adjustment in which a range of nozzles used for printing is limited and a vertical registration adjustment in which print data is shifted.

In the first aspect of the present invention, there is provided a printing method for printing by performing scanning of a print head provided with a plurality of printing element groups in a scan direction, each of which arranges a plurality of printing elements in a direction intersecting with the scan direction, the method capable of performing: a first printing position adjustment that adjusts printing positions in a arrangement direction of the printing elements between the plurality of printing element groups, in the first printing position adjustment, printing elements used for printing being limited for each of printing element groups in accordance with deviation amounts of the printing positions between the plurality of printing element groups, or a second printing position adjustment that adjusts printing positions in a arrangement direction of the printing elements between the plurality of printing element groups, in the second printing position adjustment, print data corresponding to the printing element group is shifted for each of printing element groups in accordance with deviation amounts of the printing positions between the plurality of printing element groups.

In the second aspect of the present invention, there is provided a printing apparatus for printing by performing scanning of a print head provided with a plurality of printing element groups in a scan direction, each of which arranges a plurality of printing elements in a direction intersecting with the scan direction, the apparatus capable of performing: a first printing position adjustment that adjusts printing positions in a arrangement direction of the printing elements between the plurality of printing element groups, in the first printing position adjustment, printing elements used for printing being limited for each of printing element groups in accordance with deviation amounts of the printing positions between the plurality of printing element groups, or a second printing position adjustment that adjusts printing positions in a arrangement direction of the printing elements between the plurality of printing element groups, in the second printing position adjustment, print data corresponding to the printing element group is shifted for each of printing element groups in accordance with deviation amounts of the printing positions between the plurality of printing element groups.

With the above configuration, both an improvement of a throughput by a printing apparatus and an improvement of an image quality printed by the printing apparatus can be achieved.

Further features of the present invention will become apparent from the following description of exemplary embodiments (with reference to the attached drawings).

DESCRIPTION OF THE EMBODIMENTS

Embodiments of the present invention will be described below in detail with reference to the drawings. In the following embodiments, a printing apparatus with an ink jet printing method will be described below, taking a printer as an example.

Figure 1A:
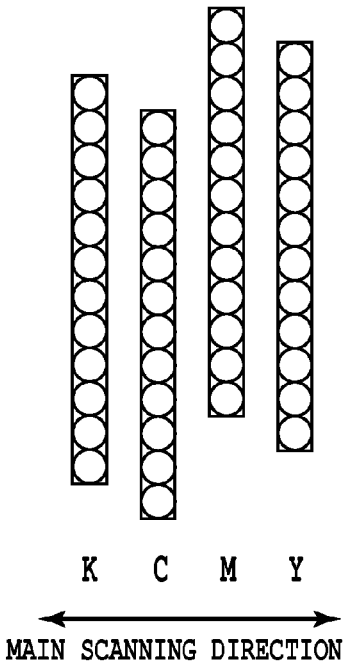
FIGS. 1A to 1C are views for explaining the misalignment of nozzles in a print head having many nozzles.
Figure 1B:
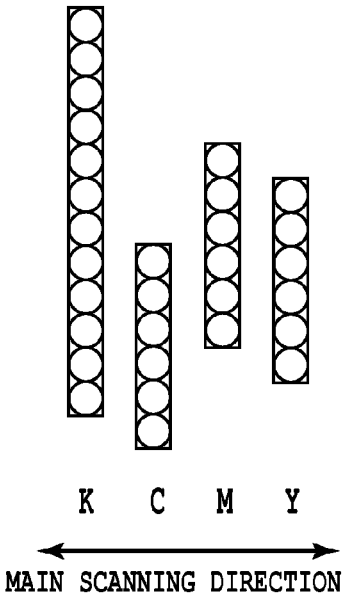
Figure 1C:
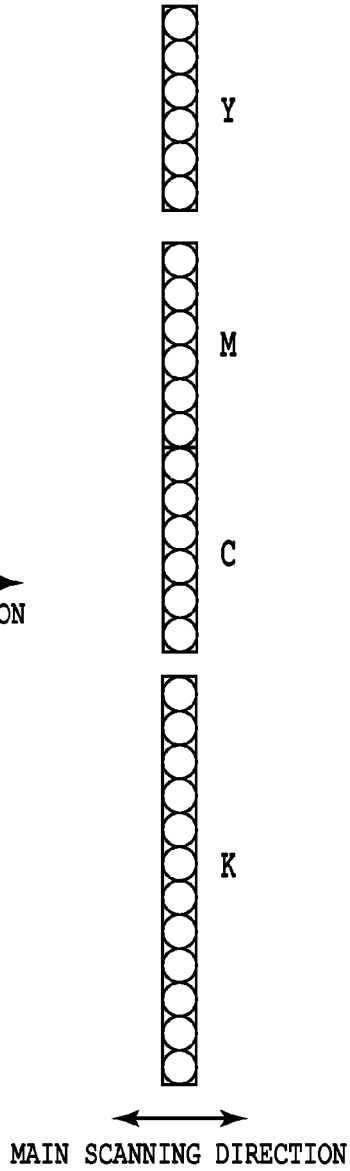
Figure 2:
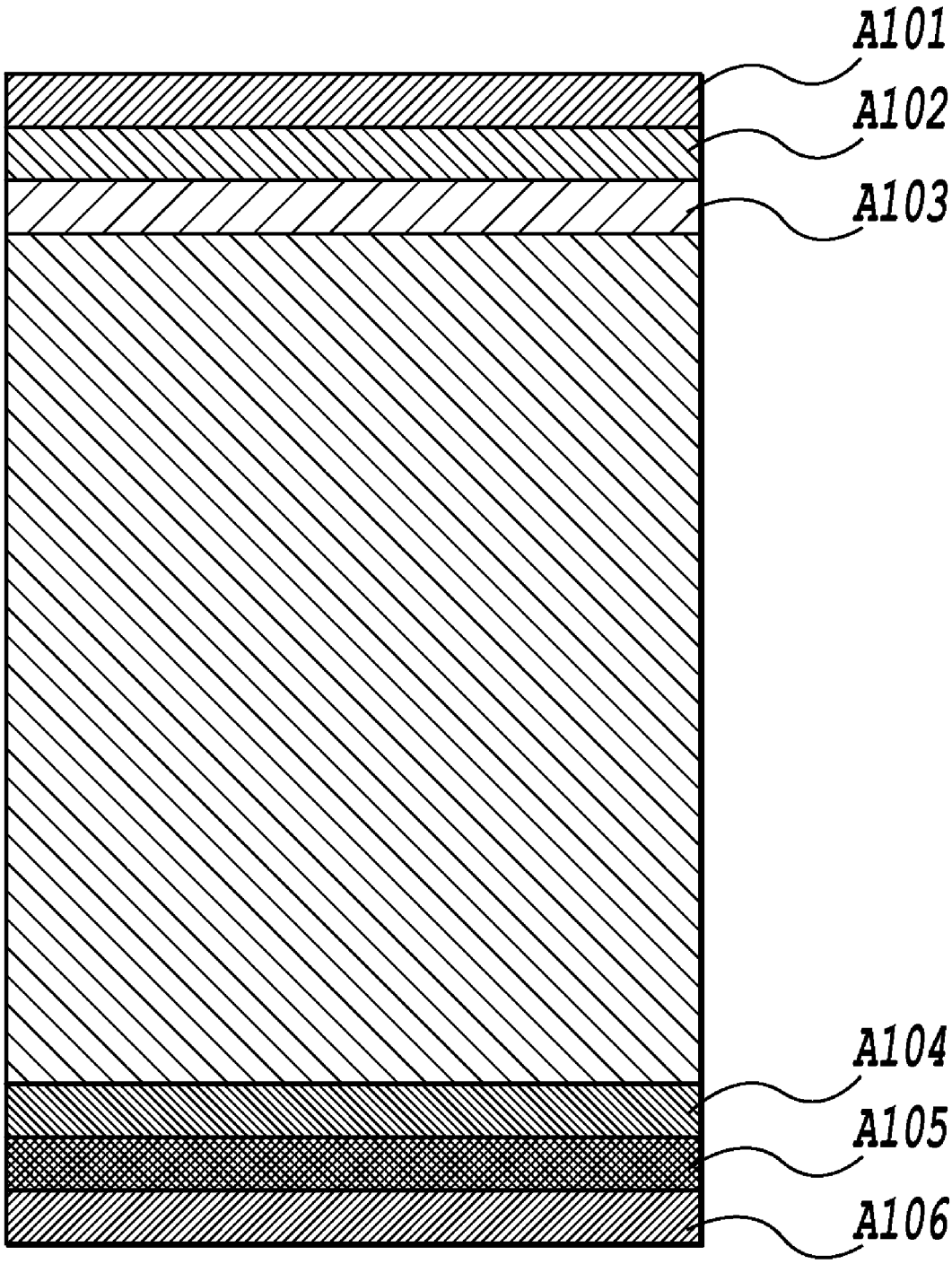
FIG. 2 is a view showing one example of the printed result using all the nozzles of the print head as shown in FIG. 1A.
Figure 3:
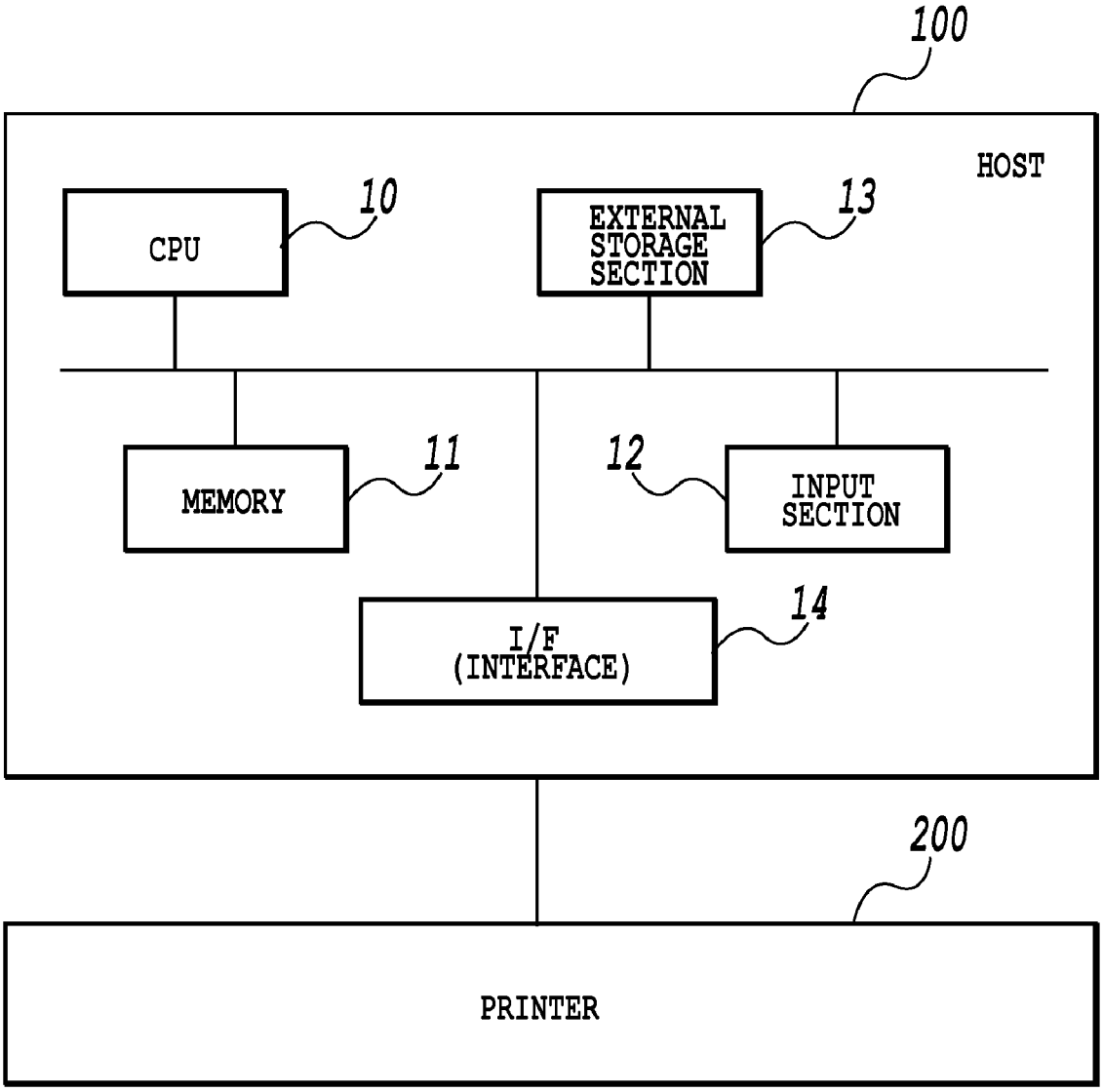
FIG. 3 is a block diagram showing the configuration of a printing system according to one embodiment of the invention.

FIG. 3 is a block diagram showing the configuration of a printing system according to one embodiment of the invention. In FIG. 3, a host 100 as an information processing apparatus is realized by a personal computer, for example. The host 100 comprises a CPU 10, a memory 11, an external storage unit 13, an input section 12 such as a keyboard, and an interface 14 for communication with the printer 200. The CPU 10 performs various processes including the processes as will be described later in FIGS. 11 and 13 in accordance with the programs stored in the memory 11. These programs are stored in the external storage unit 13, or supplied from an externally connected device. The host 100 is connected via the interface 14 to the printer 200 as the printing apparatus, and can send print data subjected to image processing to the printer 200 for performing printing.

<Printer Configuration>

Figure 4:
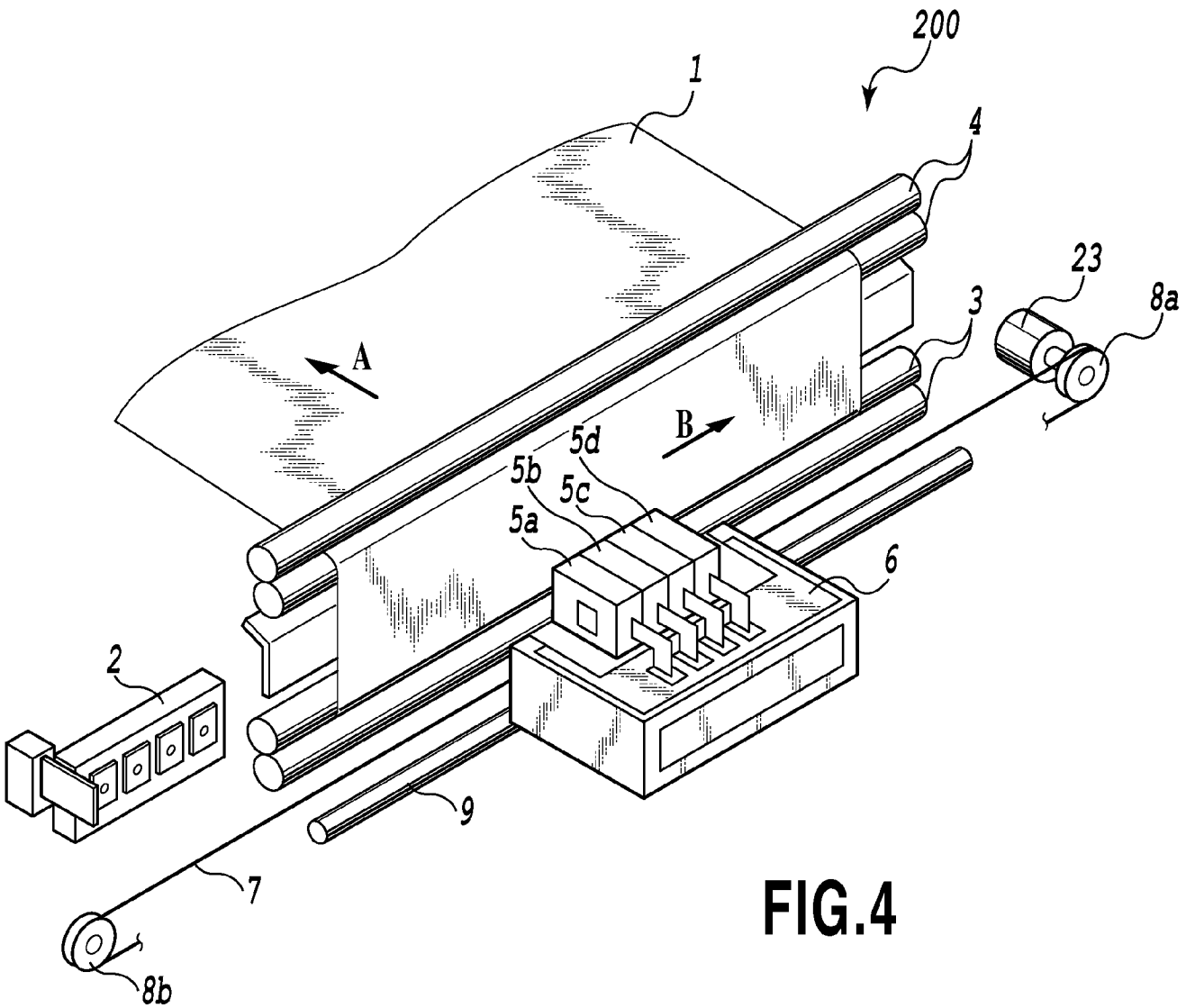
FIG. 4 is a schematic perspective view showing the mechanical constitution of a printer in the printing system.

FIG. 4 is a schematic perspective view showing the mechanical constitution of the printer 200. In FIG. 4, reference numeral 1 denotes the printing sheet such as paper or plastic sheet, in which a plurality of sheets are laid in a cassette and separated and supplied one by one by a paper feed roller (not shown) during printing. Then the sheet is conveyed every predetermined amount in a direction of the arrow A in FIG. 4 with a first pair of conveying rollers 3 and a second pair of conveying rollers 4, which are disposed at a fixed interval and driven by individual stepping motors (not shown), at the timing according to scanning of the print head.

Reference numeral 5 (5*a*, 5*b*, 5*c*, 5*d*) denotes a print head of an ink jet method for performing printing by ejecting the ink onto the print sheet 1. The ink is supplied to the print head from an ink cartridge (not shown) with an ink tank integrally provided in the print head itself, and the print head 5 ejects the ink from the ink ejection openings by being driven in accordance with a eject signal. More particularly, a plurality of electro-thermal conversion elements are provided on the ink passages corresponding to the ink ejection openings of the print head, in which an air bubble is produced in the ink using heat energy generated by this electro-thermal conversion element and the ink is ejected owing to the pressure of this air bubble. This print head 5 and the ink cartridge are mounted on a carriage 6. A driving force of a carriage motor 23 is transferred via a belt 7 and the pulleys 8*a* and 8*b* to the carriage 6, whereby the carriage 6 can be reciprocated along a guide shaft 9 to cause scanning of the print head.

With the above constitution, the print head 5 can perform the printing by ejecting ink onto the print sheet 1 in accordance with a eject signal to form dots of the inks on the sheet 1 while performing scanning of the print head in a direction of the arrow B (main scanning direction) in FIG. 4. The prim head 5 performs a recovery operation with an eject recovery device (not shown) to prevent and resolve clogging of the ejection openings by moving to a home position, as needed. The pairs of conveying rollers 3 and 4 are driven in synchronism with the scanning of the print head 5, so that the printing sheet 1 is conveyed by one line in the direction of the arrow A (sub-scanning direction). In this way, it is possible to print the image or the like on the prim sheet 1 by repeating the scanning of the prim head and the conveying of the print sheet multiple times.

Figure 5:
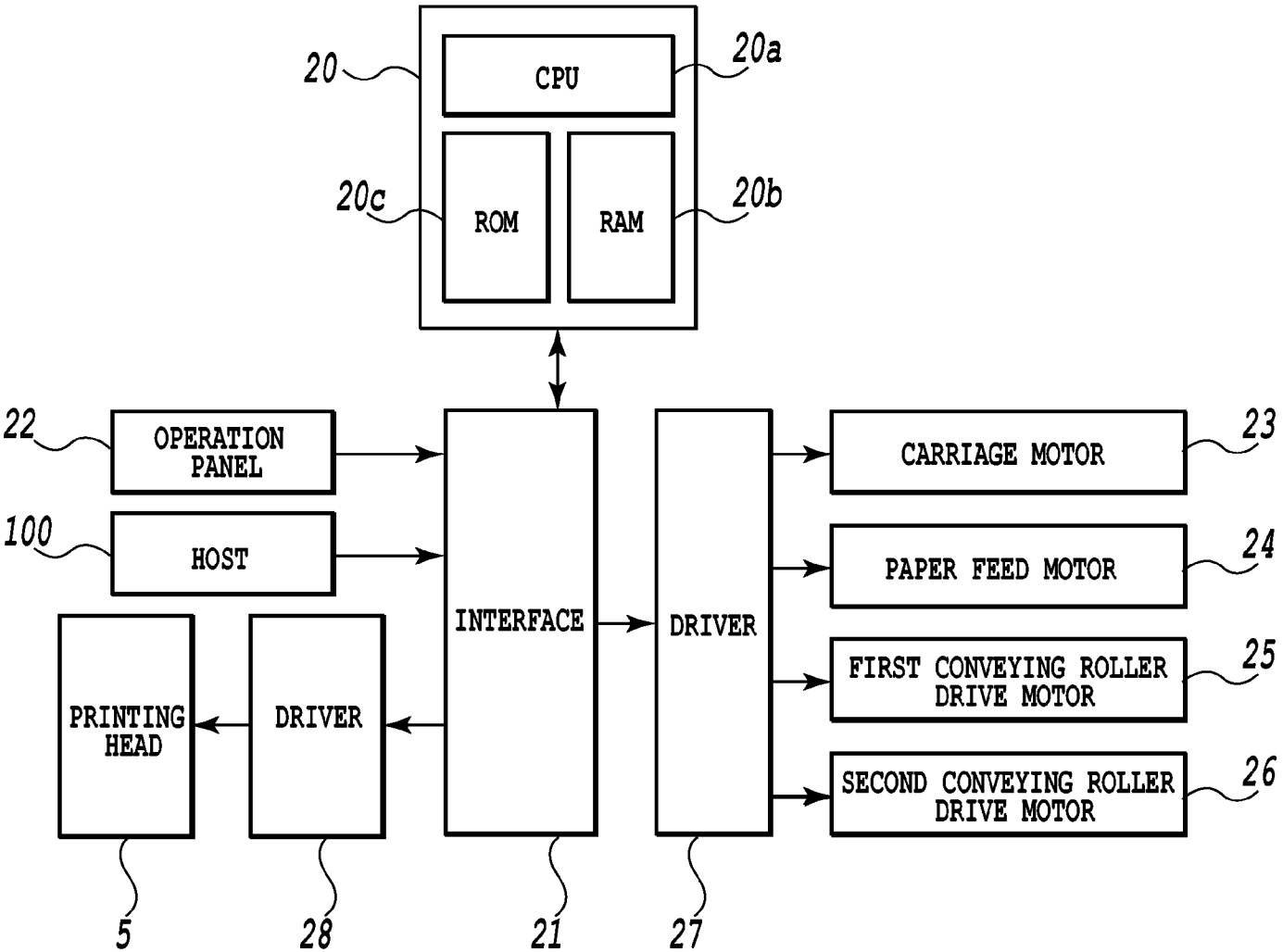
FIG. 5 is a block diagram showing a control configuration of the printer.

FIG. 5 is a block diagram showing a control configuration of the printer 200. This control system has a control section 20 comprising a CPU 20*a*, a ROM 20*c* storing a control program for the CPU 20*a*, and a RAM 20*b* useful as a work area of the CPU 20*a* and storing various kinds of data such as registration adjustment value. Also, it has an interface 21, an operation panel 22, a driver 27 for driving various kinds of motors, and a driver 28 for driving the print head 5. The motors driven by the driver 27 include a carriage driving motor 23, a paper feed driving motor 24, a first conveying roller pair driving motor 25 and a second conveying roller pair driving motor 26.

With the above configuration, via the interface 21, the control section 20 performs processes for inputting or outputting data such as print data from or to the host 100 and a process for inputting various kinds of information (e.g., character pitch, character types, etc.) from the operation panel 22. Also, the control section 20 controls the outputting an ON/OFF signal for driving each of the motors 23 to 26 via the interface 21, and the driving for ejecting the ink from the print head by outputting a eject signal to the driver 28.

Next, a process for setting a vertical registration adjustment value, a process for setting an image correction value for each scan, and an image process in each scan direction in the printing system will be described below.

<Setting of Vertical Registration Adjustment Value>

Figure 6:
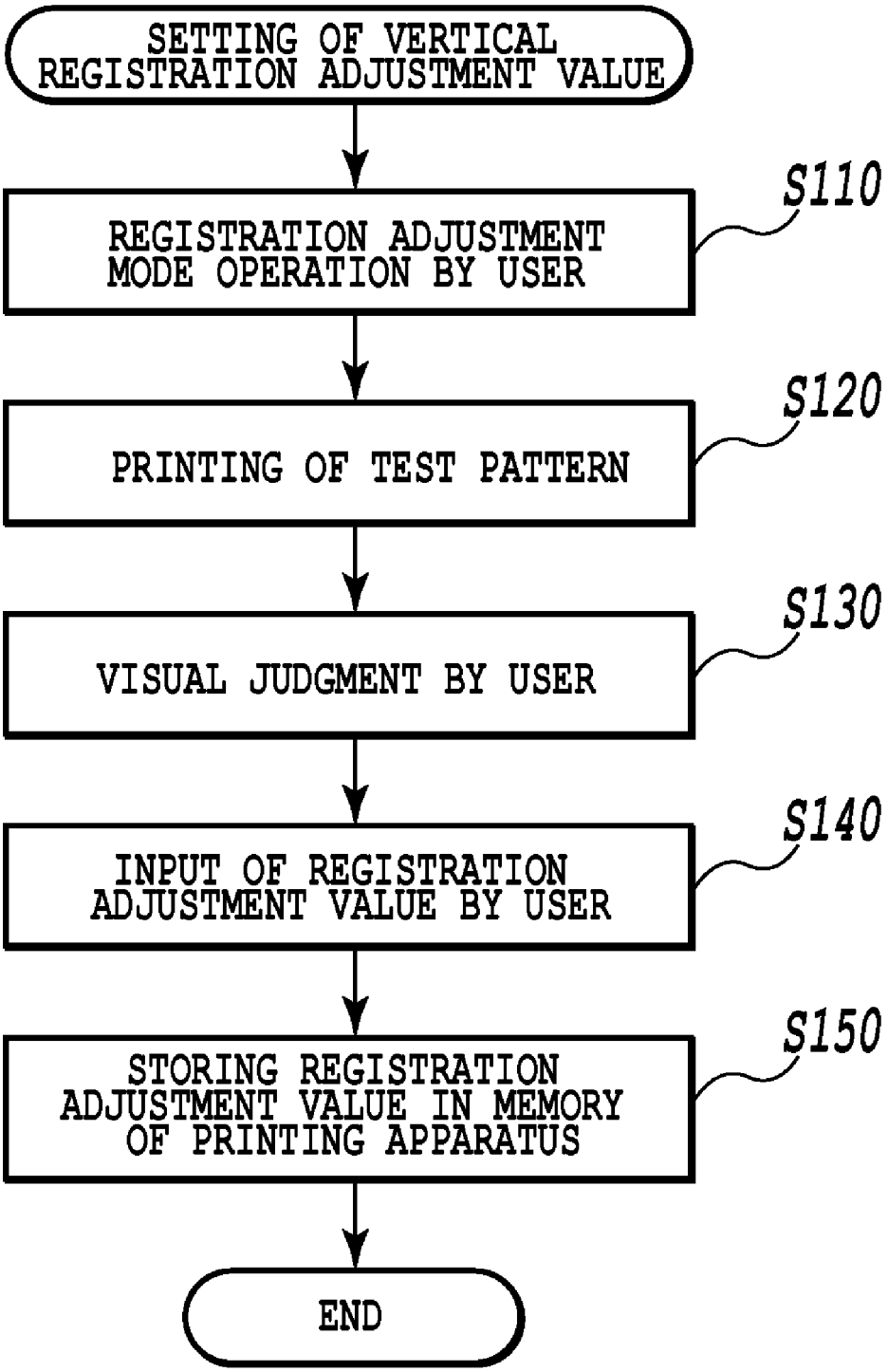
FIG. 6 is a flowchart corresponding to one example of a process for setting the adjustment value for vertical registration adjustment performed in the printer.

FIG. 6 is a flowchart showing one example of a process for setting an adjustment value of a vertical registration adjustment as a printing position adjustment process performed in the printer 200.

First, at step S110, a choice of a registration adjustment value setting mode is accepted through an operation panel of the printer 200 from a user. In response to this selection, the printer 200 prints a test pattern for setting the registration adjustment value at step S120.

Figure 7:
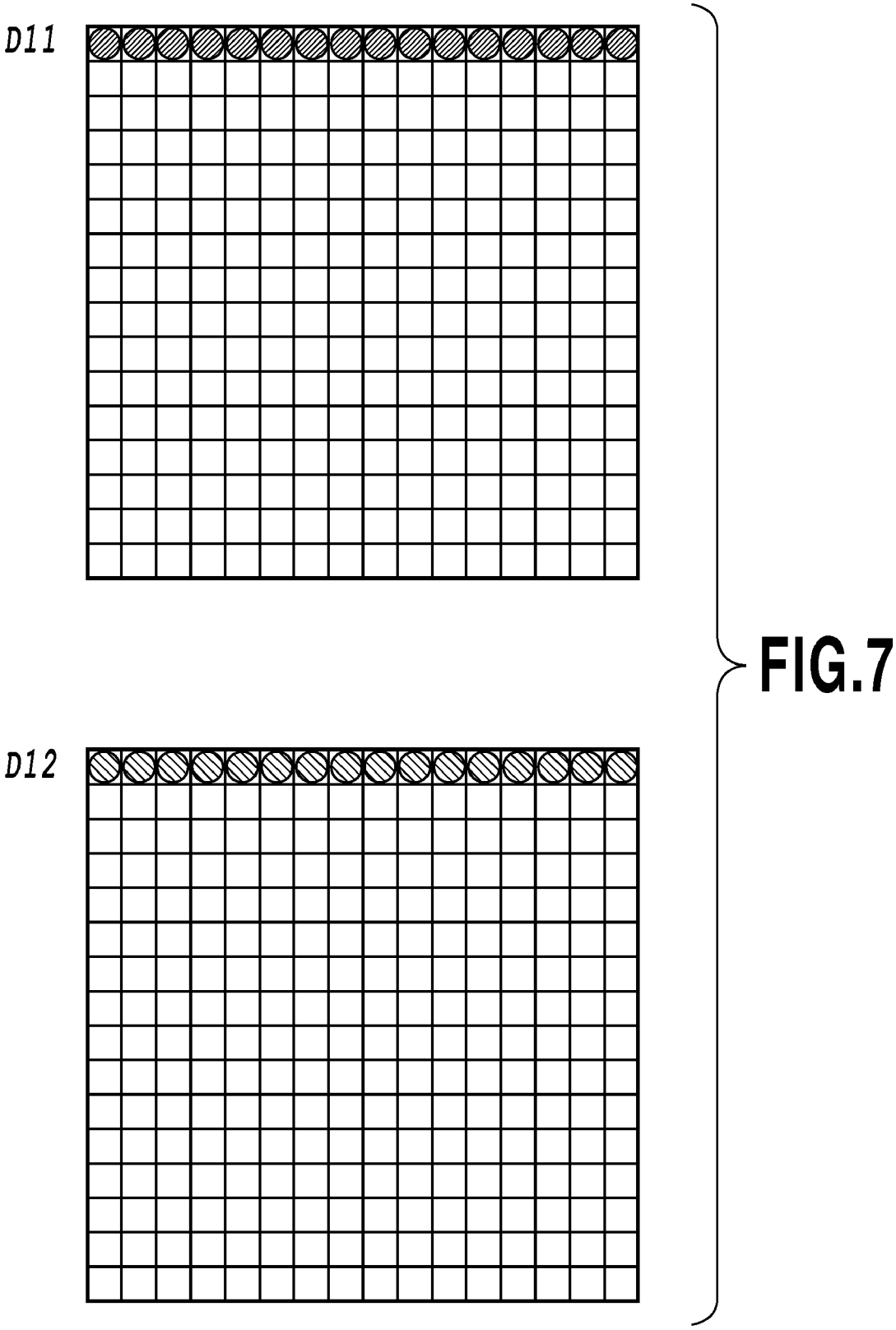
FIG. 7 is a view showing one example of test pattern data used in the registration adjustment.

FIG. 7 is a view showing one example of the test pattern data. In FIG. 7, reference signs D11 and D12 denote print data for use in reciprocally printing the test pattern, in which D11 denotes print data to be printed with a first ink and D12 denotes print data to be printed with a second ink different from the first ink. The print data D11 and D12 indicate data by which the ink is ejected from one nozzle of a plurality of nozzles arranged in the print head over a range of predetermined length in the scanning direction of the print head.

Figure 8:
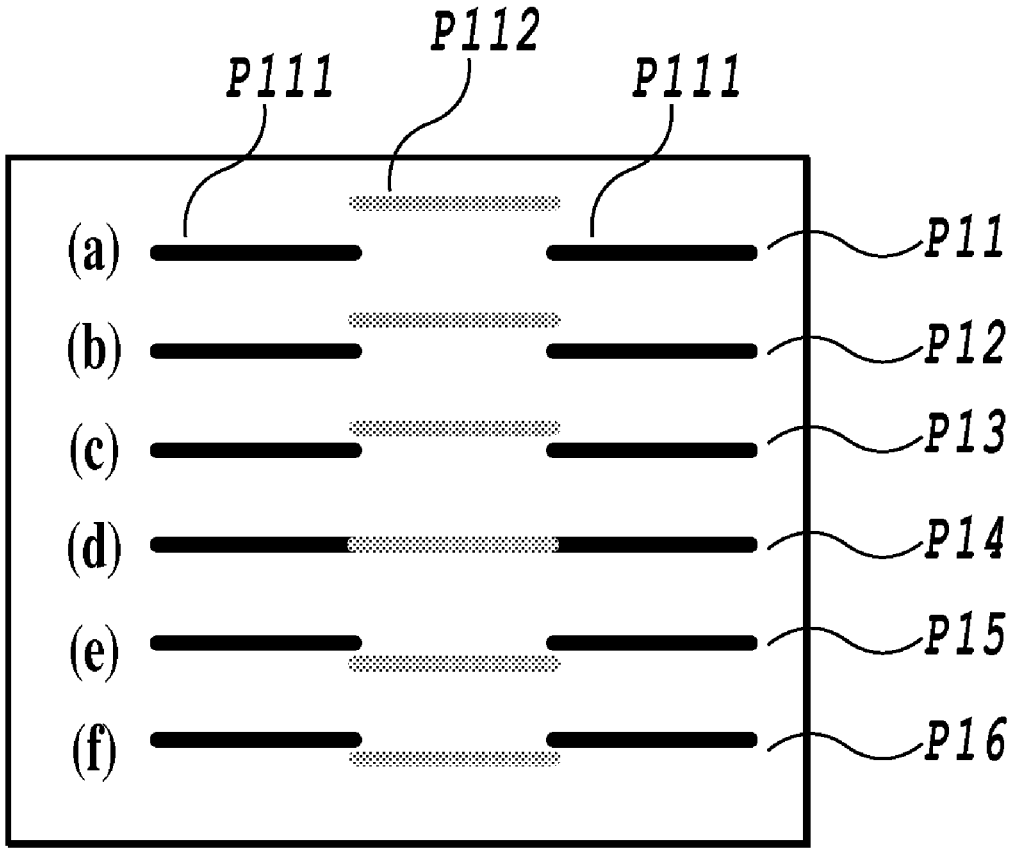
FIG. 8 is a view showing a test pattern printed using print data as shown in FIG. 7.

FIG. 8 is a view showing the test pattern printed using print data as shown in FIG. 7. At first, a pattern P11 is printed using one nozzle of the plurality of nozzles in the print head for ejecting the first ink and one nozzle of the plurality of nozzles in the print head for ejecting the second ink.

Figure 9:
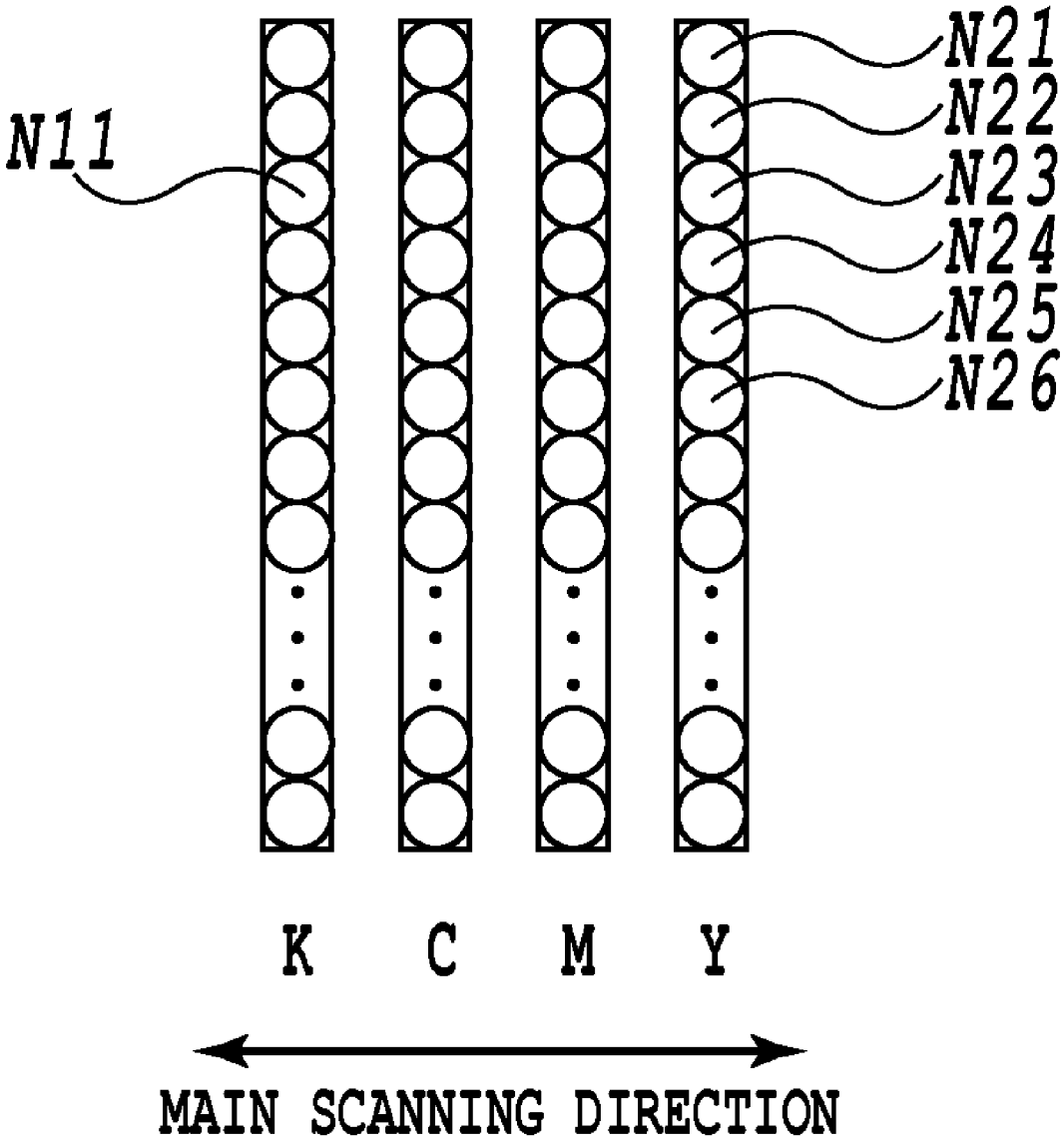
FIG. 9 is a view showing nozzle arrays of the print head that print the test pattern as shown in FIG. 8.

FIG. 9 is a view showing nozzle arrays of the print head that print the test pattern as shown in FIG. 8. The print head which ejects each color ink of black (K), cyan (C), magenta (M) and yellow (Y) has the plurality of nozzles as printing elements for each color which are arranged as a printing element group in the direction perpendicular to the main scanning direction of the print head.

The printing order of the pattern P11 includes firstly printing a pattern P111 at two locations with a nozzle N11 of the print head for ejecting the first ink (e.g., K ink), using the print data D11 in the forward scan direction, for example. Further, the printing order includes printing a pattern P112 between two patterns P111 with a nozzle N21 of the print head for ejecting the second ink (e.g., Y ink), using the print data D12 in the same scanning direction. Then, the printing medium is conveyed a predetermined amount, and a pattern P12 is printed. The pattern P12, like the pattern P11, is made by performing printing based on the print data D11 with the nozzle N11 of the print head for ejecting the first ink (K ink). Further, printing based on the data D12 is performed with the nozzle N22 of the print head for ejecting the second ink (Y ink) in the same scan direction.

Repeating the same pattern printing, the patterns P13, P14 and P15 are printed by shifting the nozzle of the head for ejecting the second ink in order of nozzles N23, N24, N25 and N26.

Turning back to FIG. 6, at the next step S130, a user selects the pattern that appears most straight line among the printed patterns as shown in FIG. 8. In an example as shown in FIG. 8, the pattern P14 is the most appropriate pattern. At step S140, the input of the selected pattern number is accepted from the user. Thereby, the registration adjustment value corresponding to the most linear pattern is determined. The registration adjustment value determined here is represented as an amount of vertical deviation of the printing element groups of a second print head for ejecting the second ink relative to the printing element groups of a first print head for ejecting the first ink, for example. This amount of deviation can be also represented as the length, or the number of nozzles. Lastly, the registration adjustment value determined at step S150 is stored in a predetermined area of the RAM 20*b* of the printer 200.

The registration adjustment value may be determined not by visual detection by a user, but by detecting a reflectance spectroscopic variation or a position variation of a pattern with use of a densitometer or a calorimeter installed in the printing apparatus.

<Setting of Image Correction Value for Each Scan>

In one embodiment of the present invention, the black stripe or white stripe on the boundary of the scanning area is corrected as image correction for each scan.

Figure 10:
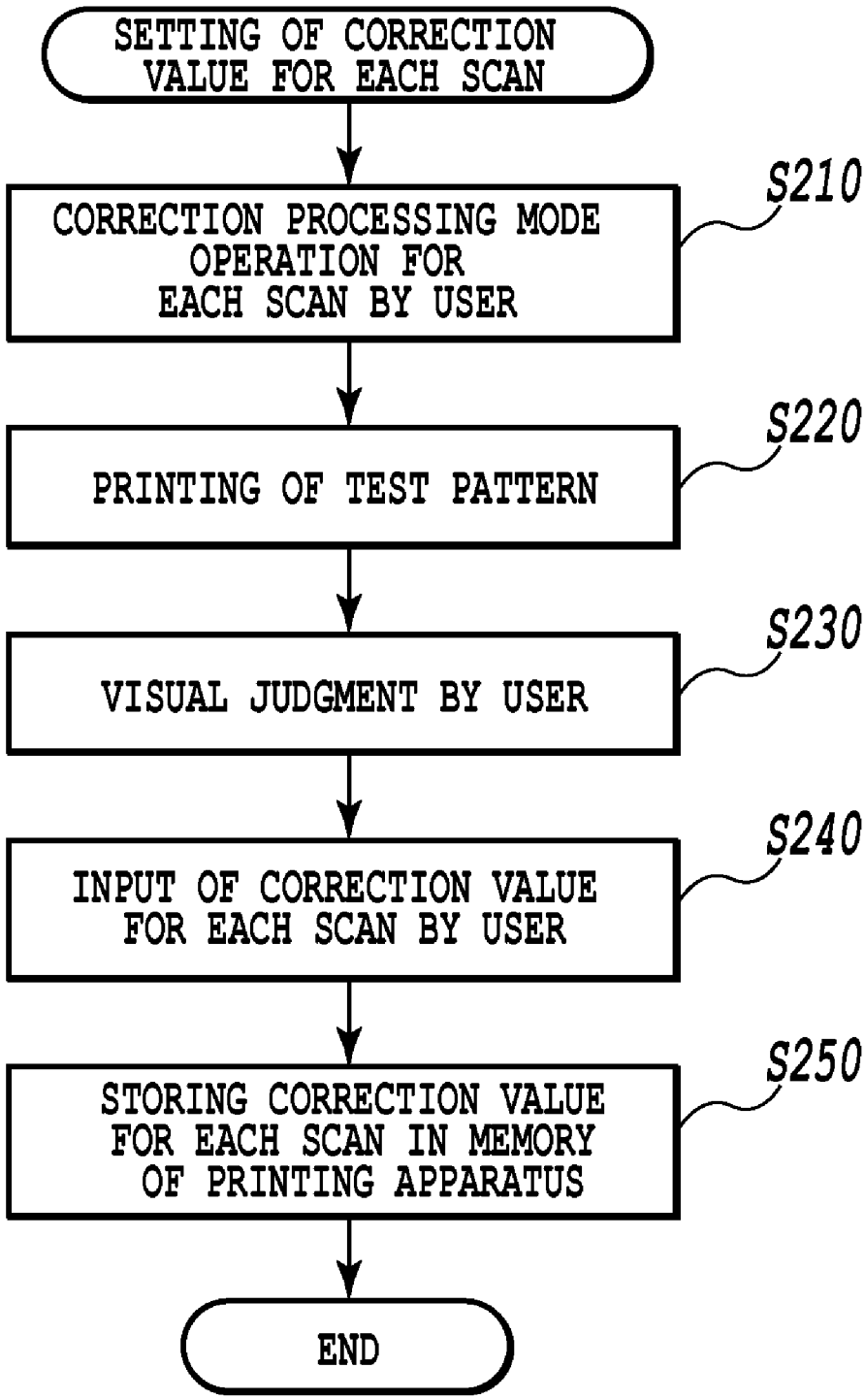
FIG. 10 is a flowchart showing a process for setting the correction value for image correction in each scan performed in the printing operation of the printer.

FIG. 10 is a flowchart showing the process for setting the correction value for image correction for each scanning performed in the printing operation of the printer 200.

First, at step S210, a choice of an image processing correction value setting mode for each scan is accepted through the operation panel of the printer 200 from a user. At step S220, the printer 200 prints a test pattern for setting the image processing correction value for each scanning. This test pattern is composed of a plurality of patterns with different thinning ratios (value of equal to or more than 100% or less than 100%) for pixels of several raster near the boundary (joint) of the scanning area, for example.

At step S230, the user selects the pattern with unnoticeable black stripe or white stripe from among the test patterns printed at step S220. Then the input of the selected pattern number is accepted from the user at step S240. Thereby, the image processing correction value for each scan corresponding to the most appropriate pattern, that is, the thinning ratio of print data near the joint, is determined. Lastly, the determined image processing correction value for each scan is stored in a predetermined area of the RAM 20*b* for the printer 200 at step S250.

<Image Processing for Each Scan Direction>

In one embodiment of the invention, an image processing different in each scan direction is performed as a process for changing a color conversion profile depending on the scan direction.

Figure 22:
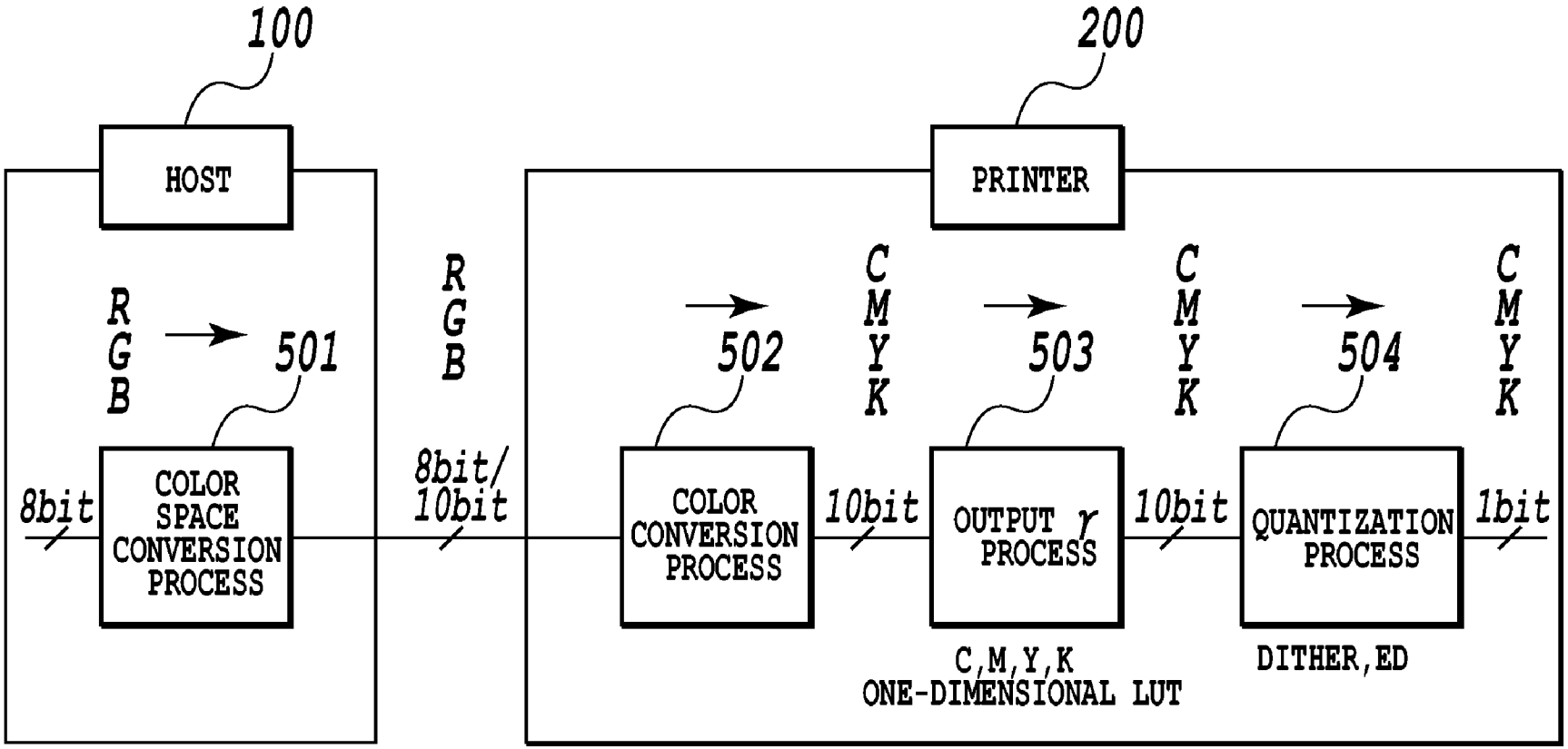
FIG. 22 is a block diagram showing the configuration of an image processing according to one embodiment of the present invention.

FIG. 22 is a block diagram showing the configuration of image processing according to the embodiment. FIG. 22 shows the image processing for generating the print data used by the printer 200 in the host apparatus 100 and the printer 200. More specifically, the image processing of this embodiment finally converts image data (brightness data) of 8 bits (256 gradations) for each color of red (R), green (G) and blue (B) into bit image data (print data) of one bit for each color of C, M, Y and K. Of course, the types of color or the gradation of color is not limited to these values.

First of all, in the host apparatus 100, a color space conversion process 501 using a three-dimensional lookup table (hereinafter referred to as an LUT) is performed to convert brightness data of 8 bits for each color of R, G and B into data of 8 bits or 10 bits for each color of R', G' and B'. This color space conversion process (also called a color preprocess) is performed to correct a difference between the color space of the input image represented by brightness data of R, G and B and the color space reproducible on the printer 200.

Data for each color of R', G' and B' subjected to the color preprocess is sent to the printer 200. In the printer 200, a color conversion process 502 using the three-dimensional LUT is performed to convert data for each color of R', G' and B' subjected to the color preprocess and received from the host apparatus into data of 10 bits for each color of C, M, Y and K. This color conversion process (also called a color post-process) is performed to make color conversion from RGB data of the input system represented by the brightness signal into CMYK data of the output system for representation in the density signal. Input data is mostly created in three additive primaries (RGB) for an illuminant such as a display, while three subtractive primaries (CMY) representing the colors by reflection of light are used in the printer, whereby the color conversion process is performed.

The three-dimensional LUT for use in the color preprocess or color post-process is represented by combination of the colors. For example, data for the points at predetermined interval (representative points or lattice points) among the points on the three-dimensional space is only prepared. If table data is prepared corresponding to all the combinations of data of 8 bits or 10 bits for each color, the volume of the three-dimensional LUT is increased, whereby data corresponding to the representative points is prepared to save required memory capacity. Accordingly, conversion of the points other than the representative points at predetermined interval into 8-bit or 10-bit data is performed using an interpolation process. This interpolation process is performed by well-known techniques.

Next, an output γ correction process 503 using a one-dimensional LUT for each color is performed for data of 10 bits for each color of C, M, Y and K subjected to the color post-process. Usually, the number of dots printed in each unit area of the printing medium and the printing characteristics such as reflection density obtained by measuring the printed image are not in the linear relation. Therefore, the output γ correction process for correcting the input gradation level of 10 bits for each color of C, M, Y and K is performed so that the input gradation level of 10 bits for each color of C, M, Y and K and the density level of the image thereby printed may be in the linear relation.

Generally, an output γ correction table (one-dimensional LUT) is created mostly for the print head having the standard printing characteristics.

After the output γ correction, a quantization process 504 with an error diffusion method is performed. Since the printer 200 of the embodiment is a binary printing apparatus, the quantization process 504 is a binarization process for binarizing data of 8 bits for each color of C, M, Y and K, which is obtained in the above way, into data of one bit for each color of C, M, Y and K. Though an error diffusion method is employed as the binarization method in this embodiment, other well-known binarization methods such as a dither method may be employed besides the error diffusion method.

The LUTs for use in the color space conversion process 501, the color conversion process 502 and the output γ correction process 503 are held on the printer 200 in this embodiment, and they may be pre-stored in the ROM 20*c* or RAM 20*b*. Also, when they are stored in the ROM 20*c*, it is desirable that plural LUTs for one purpose are prepared, and an appropriate LUT for use is selected from them. In the reciprocal bidirectional printing, the contents of the color conversion process 502 are changed between the forward direction and the backward direction as will be described next. Therefore, the LUTs for the color conversion process are stored corresponding to the respective reciprocal scans.

Figure 23:
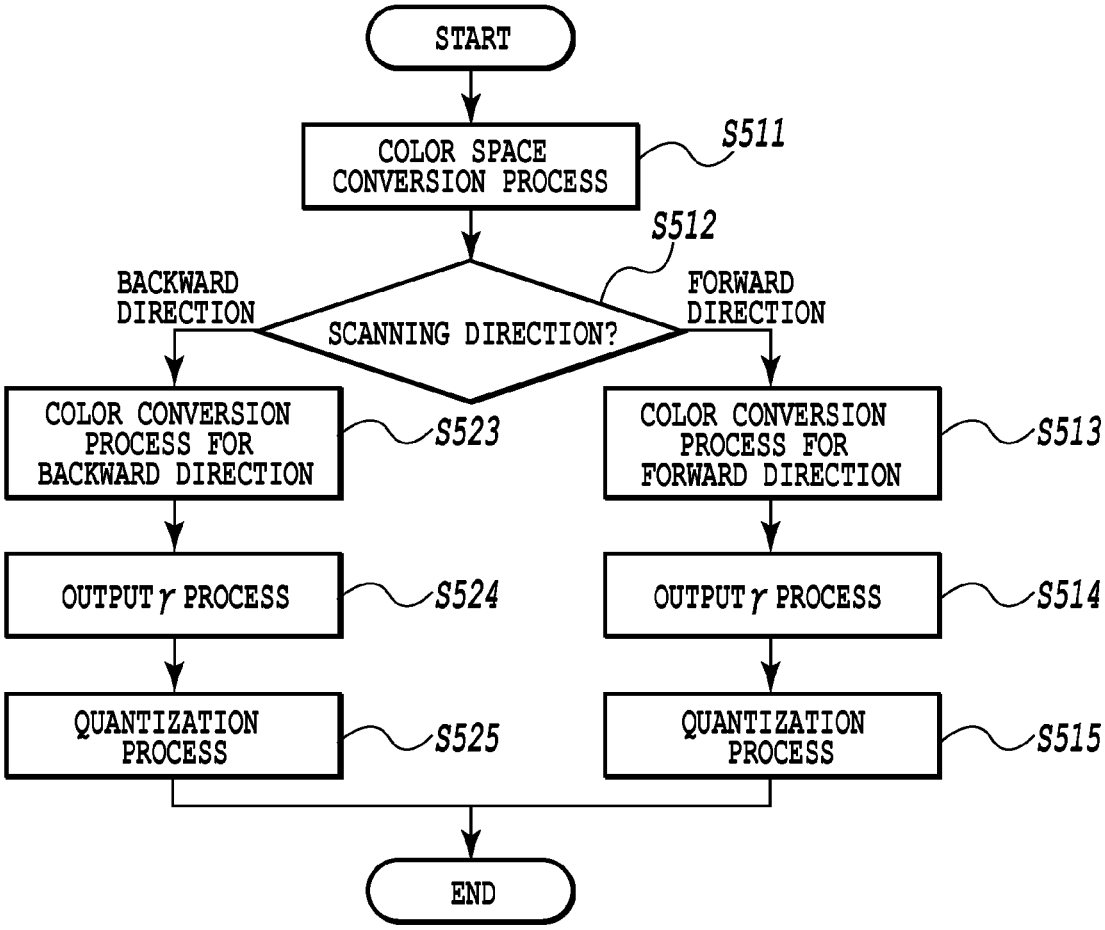
FIG. 23 is a flowchart showing the flow of the image processing for switching the color processing between the outward and backward paths in the main scanning direction in performing the printing by causing the print head to scan in both directions in the printing apparatus having the configuration as shown in FIG. 22.

FIG. 23 is a flowchart showing an image processing including a process for changing the contents of the color conversion process 502 between the forward path and the backward path in the main scan directions in the printing apparatus for performing printing by performing scanning of the print head over both directions with the above configuration. The contents of this color conversion process are changed to treat a difference in color that may occur because the color inks are superposed in a different order depending on the arrangement of nozzles for respective colors in the print head in the scan directions and on the forward direction and the backward direction for scanning.

Image data is subjected to the color space conversion process in the host apparatus (S511). Then in the printer 200, first of all, the scanning direction in printing image data is determined at step S512. If the printing is performed in the forward direction, the operation goes to step S513, or if the printing is performed in the backward direction, the operation goes to step S523.

Then at step S513, the color conversion process 502 for the forward direction is performed. That is, the color conversion process is performed using the LUT for forward direction which is made in consideration of a difference in color as described above. Thereafter, the output γ process is performed at step S514, and the quantization process is performed at step S515. For the scanning in the backward direction, the color conversion process 502 for the backward direction is similarly performed at step S523. That is, the color conversion process is performed using the LUT for backward direction. And the output γ process is performed at step S524, and the quantization process is performed at step S525.

A printing method according to an embodiment of the present invention involves appropriately switching methods for an adjustment process (vertical registration adjustment) for the printing position in the nozzle array direction of the print head. In the following, the details of a first vertical registration adjustment method and a second vertical registration adjustment method, as a method for vertical registration adjustment will be described below.

First Vertical Registration Adjustment Method

Figure 11:
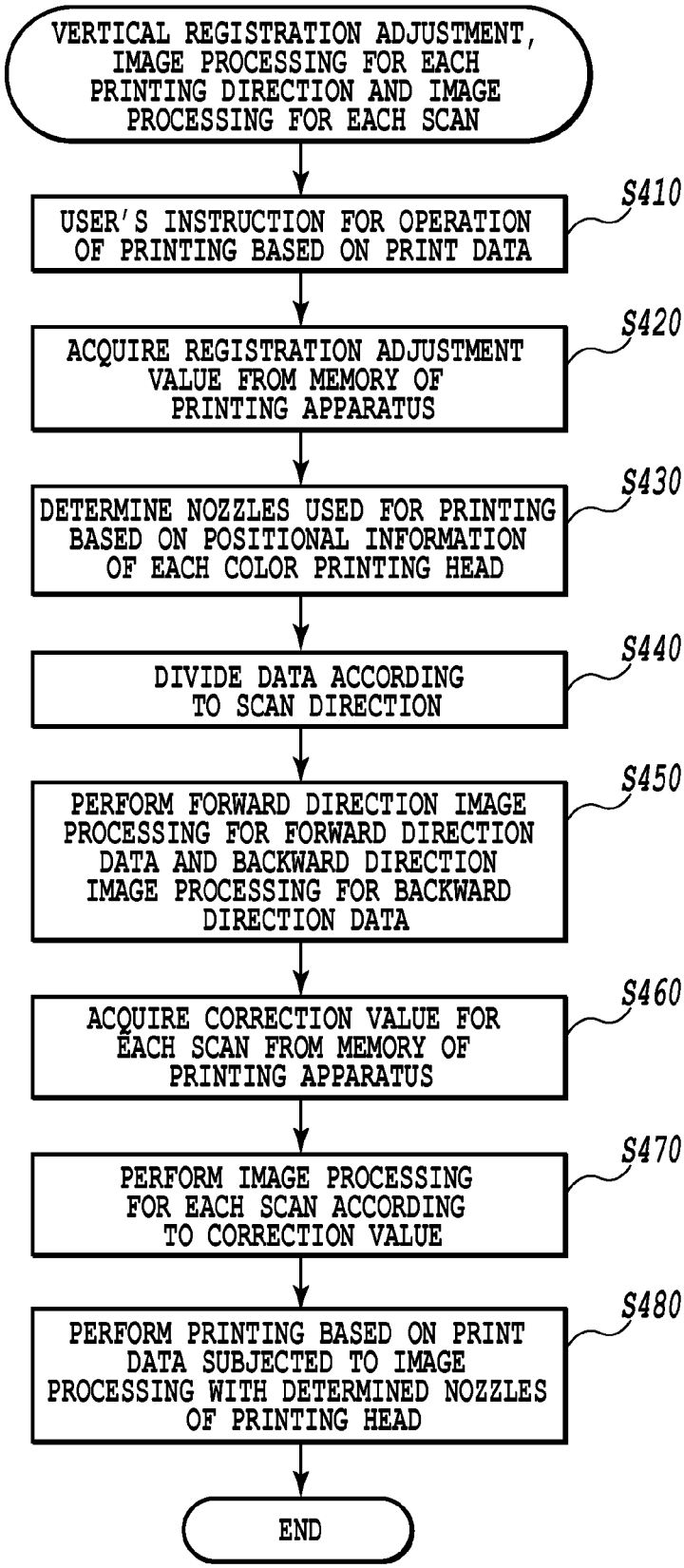
FIG. 11 is a flowchart showing a print data generation process in accordance with a first vertical registration adjustment method according to one embodiment of the invention.

FIG. 11 is a flowchart showing the print data generation process in accordance with a first vertical registration adjustment method. This process is performed by the CPU 20*a* in the printing operation of the printer 200.

First, at step S410, this process is started by accepting a printing operation command for print data from the GUI of the host 100 or a printing operation command for print data from the operation panel of the printer 200.

In the first vertical registration adjustment method, at step S420, first, the vertical registration adjustment value stored in the RAM 20*b* of the printer 200 is acquired. Then at step S430, the position information of the print head for each ink color is determined in accordance with the vertical registration adjustment value acquired at step S420, and the nozzles used for printing are determined based on the position information.

For example, as a result of setting of the vertical registration adjustment value as described in FIG. 6, when the first head is K, if the pattern selected at step S130 for each color of the second head is

C=P12

M=P15

Figure 12:
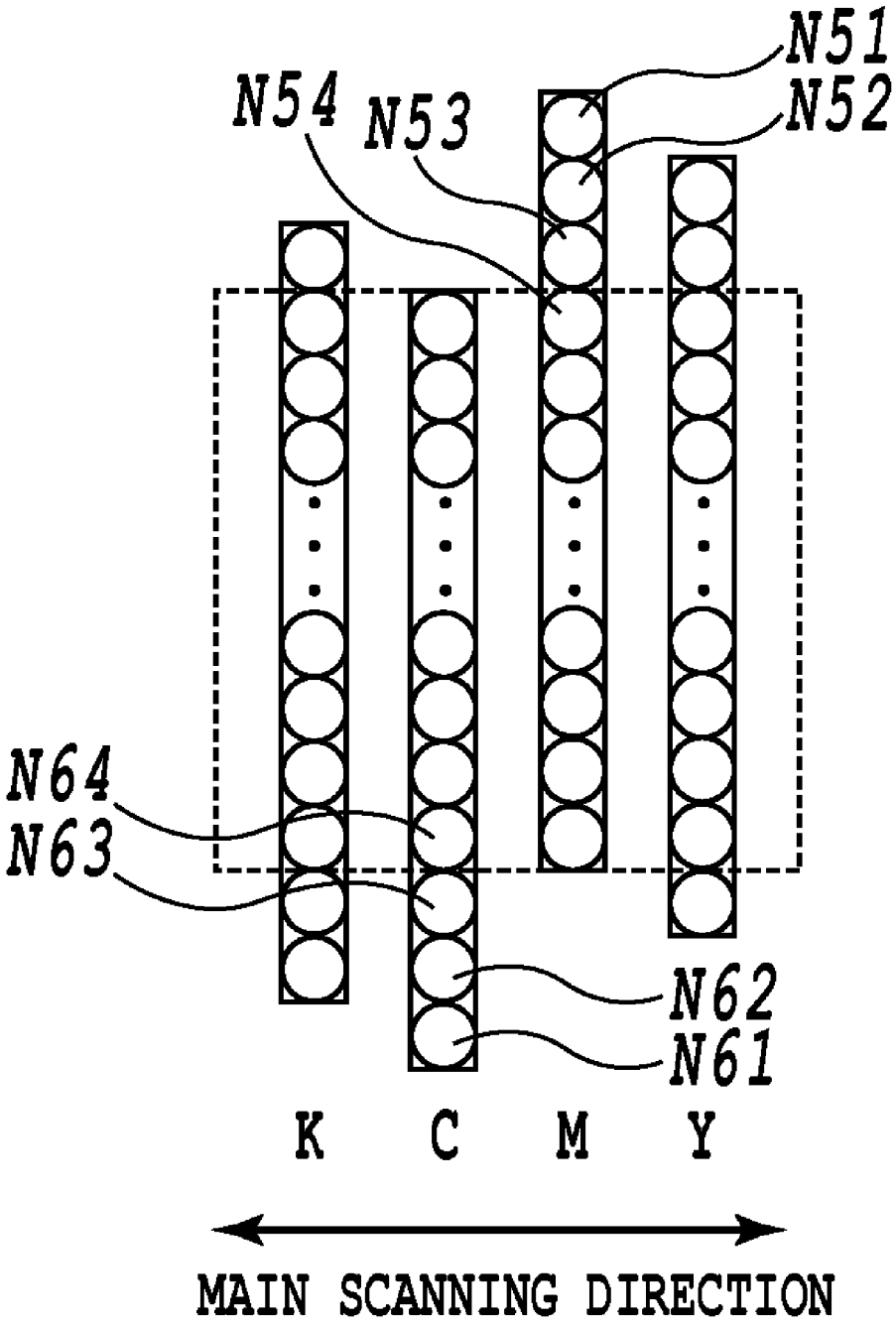
FIG. 12 is a view showing the nozzle position of the print head for each color in the first vertical registration adjustment method.

Y=P14 the nozzles of the print head for each color as shown in FIG. 9 are deviated C=one nozzle downward M=two nozzles upward Y=one nozzle upward relative to the K head. In this case, the nozzle position of the print head for each color is as shown in FIG. 12, whereby the nozzles at the same position in the main scanning direction, or the nozzles in the range from nozzles N54 to nozzles N64 surrounded by the broken line, are determined as the nozzles used for printing among the print heads for all colors. That is, a unit corresponding to the scan area in the image processing performed after this step is the area scanned with the above determined nozzle range.

When the vertical registration adjustment is terminated, the print data is divided according to the scan directions at step S440, and the image processing for each scan direction is performed according to the scan direction at step S450.

Next, the image processing correction value for each scanning stored in the RAM 20*b* of the printer 200 is acquired at step S460. Then at step S470, the image processing for each scanning is performed in accordance with the image processing correction value for each scanning acquired at step S460.

When the above process is terminated, at step S480, the printing is performed using the nozzles for use determined at step S430, based on print data subjected to image processing at step S470.

As described above, according to the first vertical registration adjustment method, the use range of nozzles without deviation is determined through the vertical registration adjustment. Thereby, even if the process for each scan area, namely, the image processing associated with the nozzles of the print head is performed, after the vertical registration adjustment, the print data after the processing is not deviated from the scan area corresponding to the use range of nozzles.

Second Vertical Registration Adjustment Method

Figure 13:
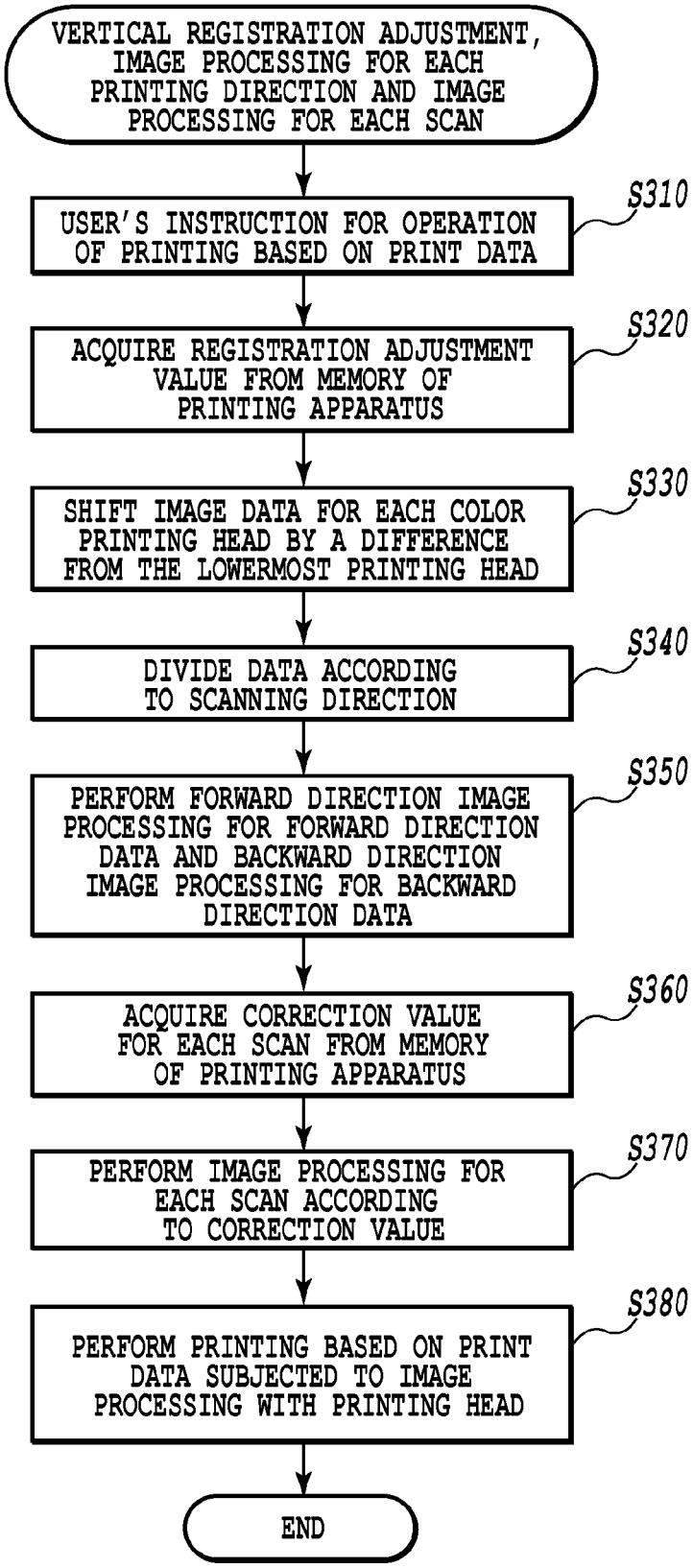
FIG. 13 is a flowchart showing a print data generation process in accordance with a second vertical registration adjustment according to one embodiment of the invention.

FIG. 13 is a flowchart showing the print data generation process in accordance with a second vertical registration adjustment method. This process is similarly performed by the CPU 20*a* in the printing operation of the printer 200.

First, at step S310, this process is started by accepting a printing operation command for print data from the GUI of the host 100 or a printing operation command for print data from the operation panel of the printer 200.

At step S320, firstly, the vertical registration adjustment value stored in the RAM 20*b* of the printer 200 is acquired. Then at step S330, the image data for each ink color is shifted by a difference from the print head with the largest downward deviation of the printing position, according to the vertical registration adjustment value acquired at step S320.

For example, as a result of setting of the vertical registration adjustment value as described in FIG. 6, when the first head is K, if the pattern selected at step S130 for each color of the second print head is

C=P12,

M=P15 and

Y=P14, the nozzles of the print head for each color as shown in FIG. 9 are deviated relative to the K head (see FIG. 12) as shown below.

C=one nozzle downward

M=two nozzles upward

Y=one nozzle upward

Figure 14:
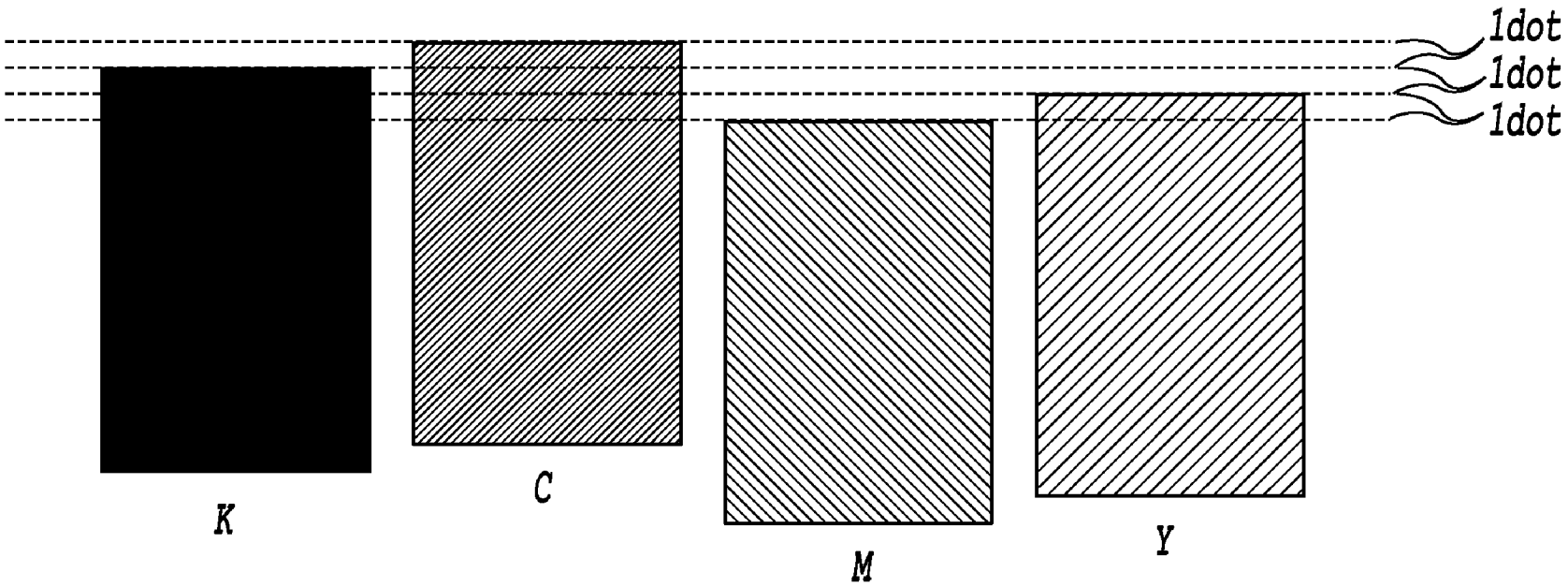
FIG. 14 is a view showing the nozzle position of the print head for each color in the second vertical registration adjustment method.

In this case, the C print head is the print head with the largest downward deviation, and the image data for each color is shifted by a difference of deviation amount from the C print head in the reverse direction, as shown in FIG. 14. That is, the image data for each color is shifted as shown below.

K=one nozzle (dot) in lower direction

M=three nozzles (dots) in lower direction

Y=two nozzles (dots) in lower direction

Next, the image data is divided according to the scan directions at step S340, and the image processing for each scan direction is performed according to the scan direction at step S350.

Next, at step S360, the image processing correction value for each scanning stored in the RAM 20*b* of the printer 200 is acquired. Then at step S370, the image processing for each scanning is performed in accordance with the image processing correction value for each scanning acquired at step S360.

Lastly, at step S380, the printing is performed based on print data shifted at step S370.

As described above, according to the second vertical registration adjustment method, the image data is shifted as a whole in accordance with the amount of deviation of the printing position. Thereby, the correspondence between the print data after the vertical registration adjustment and the nozzles associated with the scanning area is not deviated.

Switching Between the First Vertical Registration Adjustment and the Second Vertical Registration Adjustment The first vertical registration adjustment method limits nozzles used for printing and therefore may have influence on the throughput, but is implemented cheaply because there is no need for a buffer for shifting the image or the processing capability. On the other hand, the second vertical registration adjustment method has no influence on the throughput, because all the nozzles can be employed, but may be not properly performed to cause deterioration of printed image in the case that an image resolution at a vertical direction is lower than a nozzle arrangement resolution. For example, when print heads each of which has the resolution of 1200 dpi (1/1200 inch) are arranged in out of alignment, the registration adjustment value (shift amount) needs to have a resolution of 1200 dpi. However, in the case that the image resolution is lower than 1200 dpi, for example is 600 dpi, print data is shifted only at 600 dpi lower than the nozzle arrangement resolution, which may cause a case that print data is shifted at smaller amount than a proper shift amount or a case that print data is shifted at greater amount than a proper shift amount.

Based on the above described problem, the embodiment of the present invention switches between the first vertical registration adjustment method and the second vertical registration adjustment method in accordance with a printing condition in performing printing.

1. Switching in Accordance with Printing Nodes

A printing apparatus according to the present embodiment is capable of executing three printing modes which are provided corresponding to qualities of printed image that a user requires and a printing speed. A user can select a "fine" mode when the user requires high quality print image even if time required for printing is long, a "high speed" mode when the user requires the time required for printing to be short even if print quality decreases, or a "normal" mode when the requires normal print quality and normal printing speed. For these printing modes, a driving resolution, a carriage speed, a number of pas for a multi-pass printing and the like are properly set so that image printing optimized to user's various needs can be implemented.

Consequently, the printing apparatus of the present embodiment performs the first vertical registration adjustment in which a range of nozzles used for printing is limited and then performs printing, in the case that the "normal" mode or the "fine" mode is selected. On the other hand, the printing apparatus performs the second vertical registration adjustment in which print data is shifted and then performs printing, in the case that the "high speed" mode is selected.

According to the above configuration, in a mode for which time taken for printing is required to be short, printing is performed with use of all nozzles in each of nozzle arrays and therefore throughput can be prevented from decreased. On the other hand, in a mode for which high quality printing is required, deterioration of printed image quality due to a mismatch between an image resolution in a vertical direction and a nozzle resolution can be prevented. In this way, suppressing a decrease of throughput and an improvement of print quality can be implemented together.

It should be noted that the second vertical registration adjustment may be performed and then printing may be performed, in the case that the "normal" mode is selected.

2. Switching in Accordance with Types of Printing Medium

It may be possible that a vertical registration adjustment is switched between the first vertical registration adjustment and the second vertical registration adjustment, in accordance with types of printing medium.

More specifically, a plain paper is often used for printing a document and the printing document usually requires high speed printing rather than high quality printing. In contrast, a high quality paper such as a glossy paper is often used for printing an image such as a photograph image and the printing image usually requires high quality printing rather than an improvement of throughput.

Consequently, the printing apparatus of the present example performs the first vertical registration adjustment in which a range of nozzles used for printing is limited and then performs printing, in the case that the plain paper is used as printing medium. On the other hand, the printing apparatus performs the second vertical registration adjustment in which print data is shifted and then performs printing, in the case that the high quality paper is used as a printing medium.

According to the above configuration, increasing printing speed and an improvement of print quality can be implemented together.

3. Switching in Accordance With the Number of Scans

Switching between the first vertical registration adjustment and the second vertical registration adjustment is performed in accordance with as whether a number of times of scanning increases or not when the first vertical registration adjustment in which a range of nozzles used for printing is limited is performed.

For example, when taking a case of printing an image having a length equivalent to 2560 nozzles (equivalent to 2560 dots) in a vertical direction (sub-scanning direction) with use of a print head in which a number of nozzles in each of nozzle arrays, as an example, printing of the image is completed with ten times of scanning in the case of performing no vertical registration adjustment or of performing the second vertical registration adjustment that is capable of using all nozzles in each nozzle array. On the other hand, when nozzles used for printing is limited to 254 nozzles of 256 nozzles in case of performing the first vertical registration adjustment, the number of times of scanning required for completing printing the above sized image.

In this regard, when performing printing, the vertical second registration adjustment is employed in the case that the number of times of scanning increases and the first vertical registration adjustment is employed in the case that the number of times of scanning does not increase. Thereby, an improvement of print quality can be realized without causing decrease of the throughput.

It should be noted that the number of times of scanning required for completing printing of the image is determined based on a vertical registration adjustment value (shift amount) and a size of image in a vertical direction and therefore a vertical registration adjustment method is switched based on the vertical registration adjustment value and the size of image in a vertical direction. Further, the above determination is executed for each image of fixed size such as one page.

4. Switching in Accordance With an Image Resolution

Switching between the first vertical registration adjustment and the second vertical registration adjustment is performed in accordance with an image resolution in a vertical direction (sub-scanning direction).

First, an image data resolution in a vertical direction is acquired and the acquired resolution and the resolution nozzle array (an interval of adjacent nozzles) are compared with each other. Then the first vertical registration adjustment in which use nozzles are limited is employed in the case that the image resolution is lower than the resolution of nozzle array. Thereby, the problem that proper registration value can not be set due to a mismatch between the image resolution and the resolution of nozzle array can be prevented. On the other hand, the second vertical registration adjustment in which print data is shifted and all nozzles are used is employed in the case that the image resolution is equal to or higher than the resolution of nozzle array. Thereby, printing of high quality image can be achieved and the throughput is prevented from decreasing.

According to the above configuration, increasing printing speed and an improvement of print quality can be implemented together.

Another Example 1 of Registration Adjustment Pattern Printing

In the above embodiments, the same test pattern is printed by changing the nozzles for use in the second head for printing. Alternatively, the test pattern may be changed for printing, using the same nozzles. In the following, a method for printing the test pattern by changing the test pattern will be described below.

Figure 15:
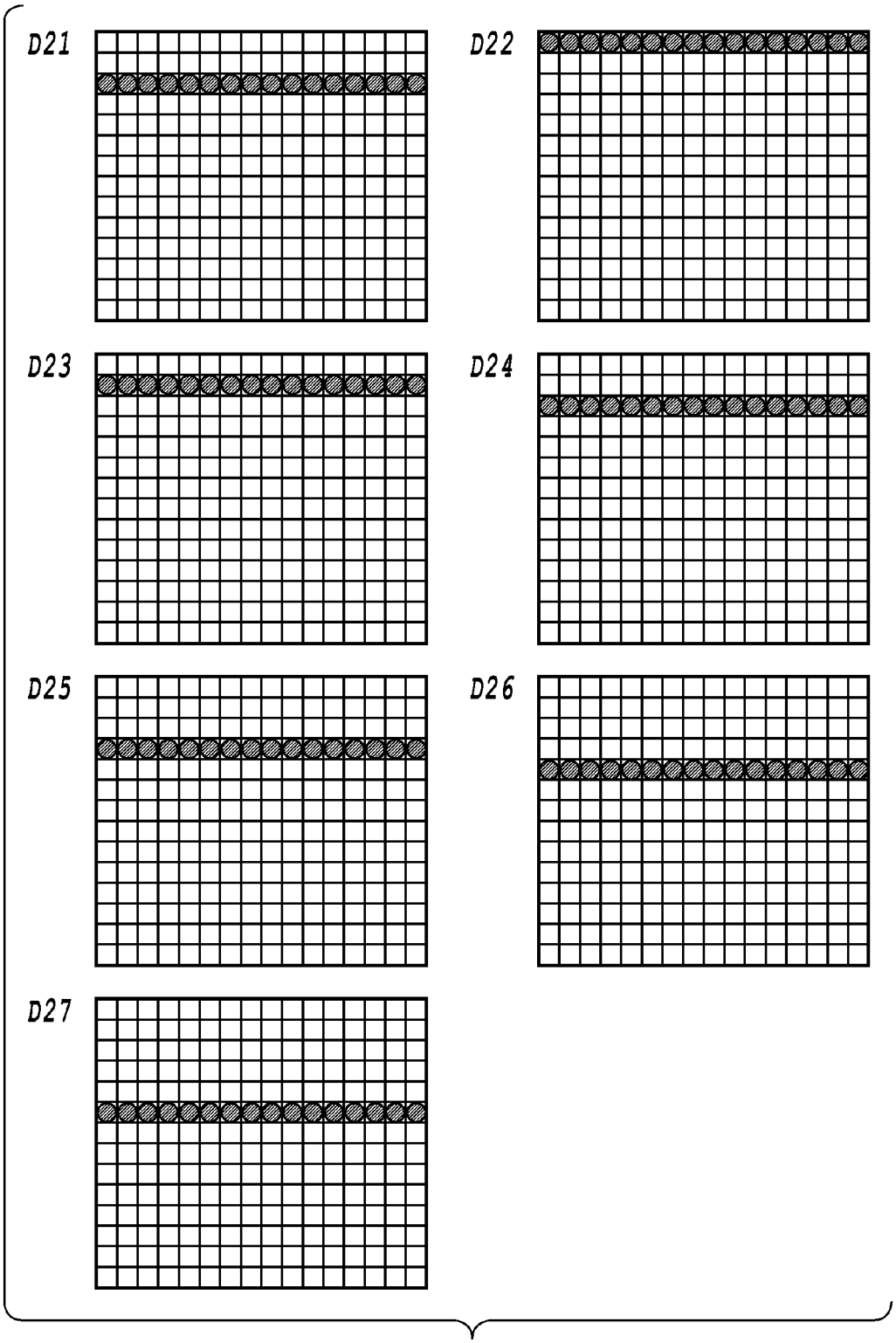
FIG. 15 is a view showing another example of test pattern data printed for setting the registration adjustment value.

FIG. 15 is a view showing the test pattern data to be printed for setting the registration adjustment value in this example. In FIG. 15, reference sign D21 denotes the print data to be printed with the first ink, and reference signs D22 to D27 denote the print data to be printed with the second ink.

The test pattern printed using the print data of FIG. 15 is shown in FIG. 8. Firstly, the pattern P11 is printed using a part of the plural nozzles in the print head for ejecting the first ink and a part of the plural nozzles in the print head for ejecting the second ink.

Figure 16:
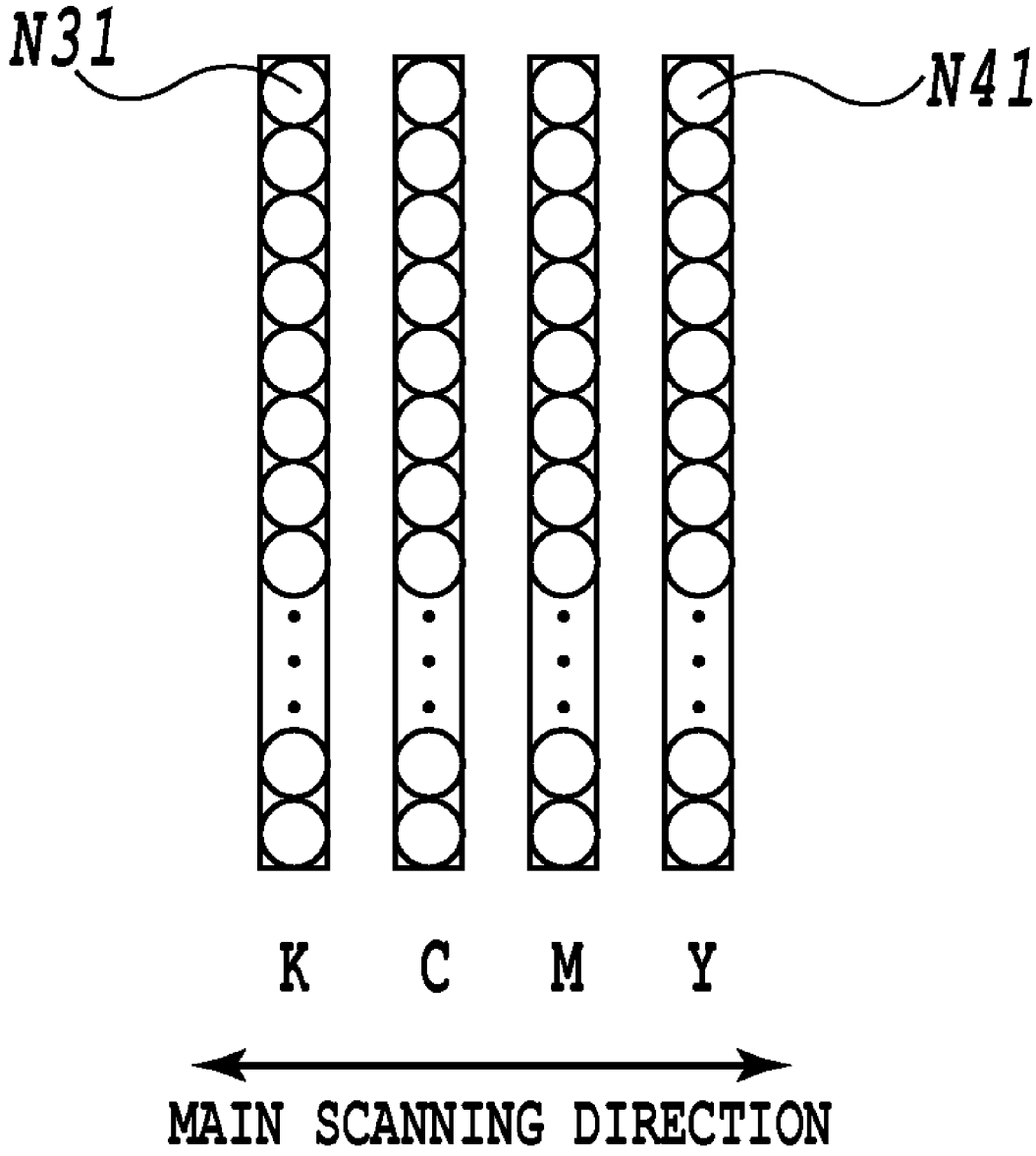
FIG. 16 is a view showing the print head for printing the test pattern based on data of FIG. 15.

FIG. 16 is a view showing the print head for printing the test pattern shown in FIG. 8. The nozzles for each color in the print head for ejecting the ink of each color of K, C, M and Y are arranged vertically to the main scanning direction of the head.

The printing order of the pattern P11 includes firstly printing the pattern P111 with the nozzle N31 of the print head for ejecting the first ink (e.g., K ink) using the print data D21 in the forward direction, for example. Further, it includes printing the pattern P112 with the nozzle N41 of the print head for ejecting the second ink (e.g., Y ink) using the data D22 in the same scanning direction.

Then, the printing medium is conveyed, and the pattern P12 is printed. The pattern P12, like P11, is made by printing the print data D21 with the N11 nozzle of the print head for ejecting the first ink (e.g., K ink). Further, based on the data D23 the pattern is printed with the nozzle N41 of the print head for ejecting the second ink (e.g., Y ink) in the same scanning direction. By repeating this operation in the following, the patterns P13, P14 and P16 are printed by the print head for ejecting the second ink by gradually shifting the print data in order of D24, D25, D26 and D27.

Another Example 2 of Registration Adjustment Pattern Printing

Though the above test pattern is a pattern looks like the straight line, the pattern may be a pattern of a band looks like uniform.

Figure 17:
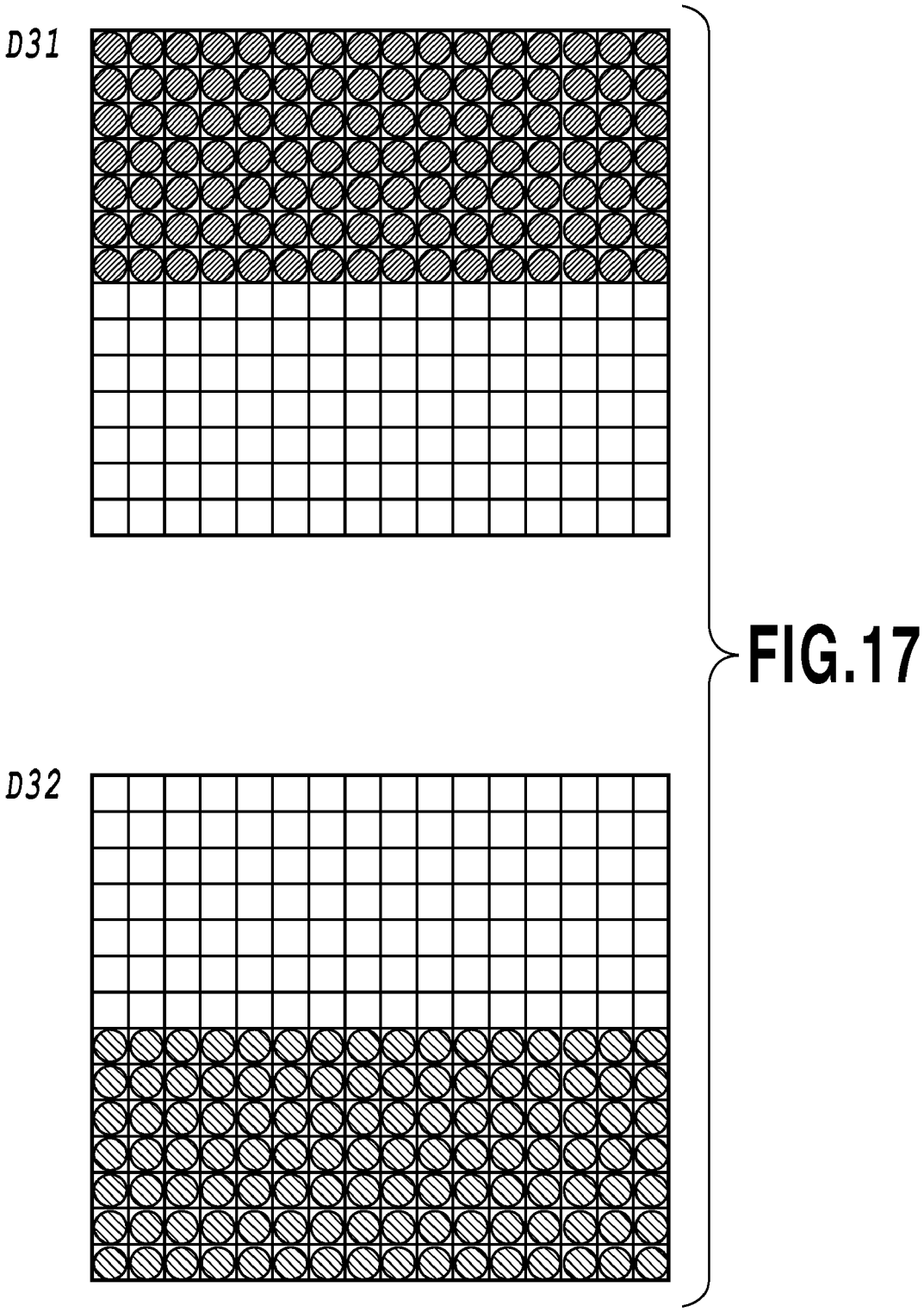
FIG. 17 is a view showing another example of test pattern data printed for setting the registration adjustment value.

FIG. 17 is a view showing the test pattern data to be printed for setting the registration adjustment value in this example. In FIG. 17, reference signs D31 and D32 denote the print data for use in reciprocally printing the test pattern, in which reference sign D31 denotes the print data to be printed with the first ink, and reference sign D32 denotes the print data to be printed with the second ink.

Figure 18:
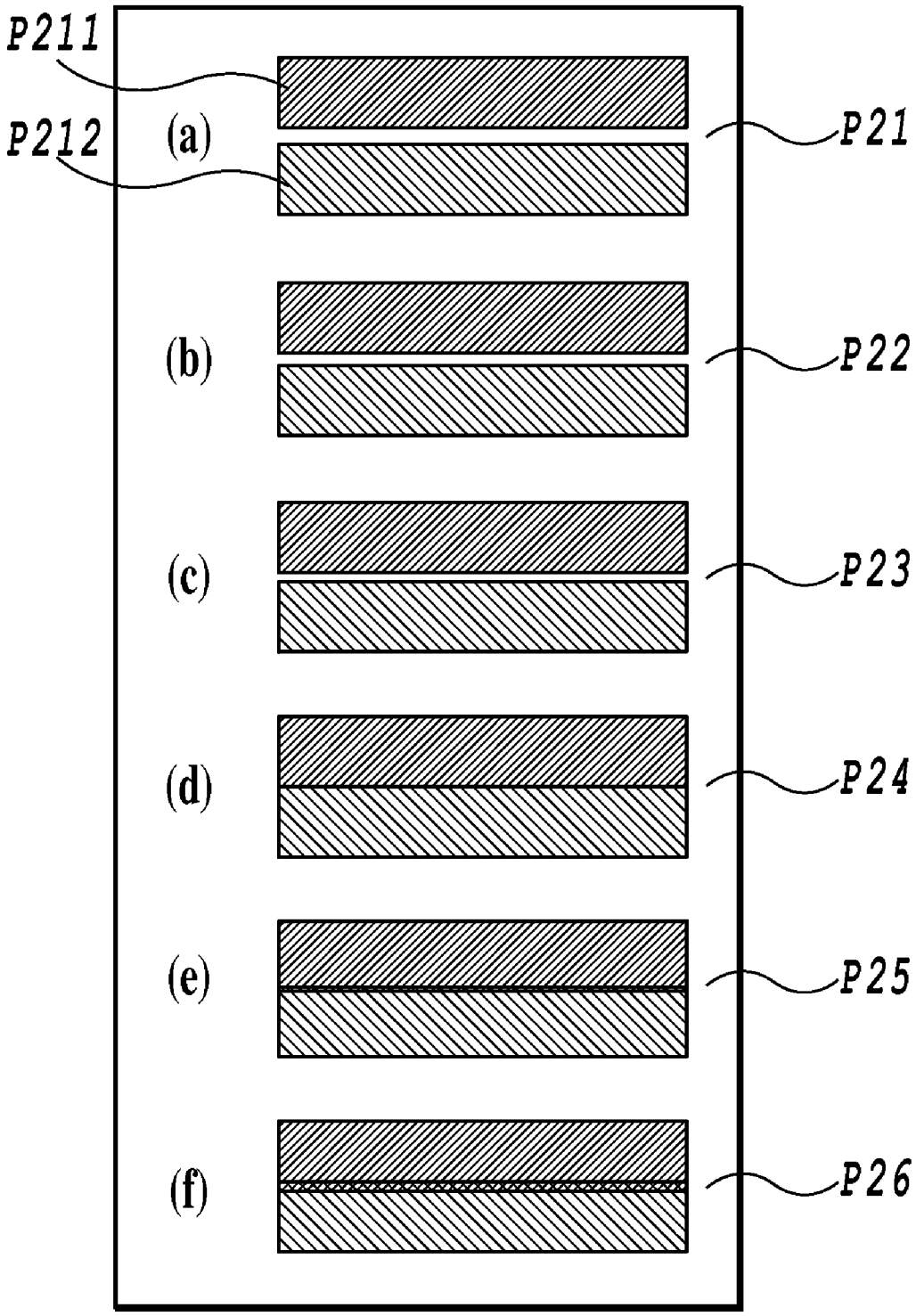
FIG. 18 is a view showing the test pattern printed using print data of FIG. 17.

FIG. 18 is a view showing the test pattern printed using the print data shown in FIG. 17. Firstly, the pattern P21 is printed using a part of the plural nozzles in the print head for ejecting the first ink and a part of the plural nozzles in the print head for ejecting the second ink.

Figure 19:
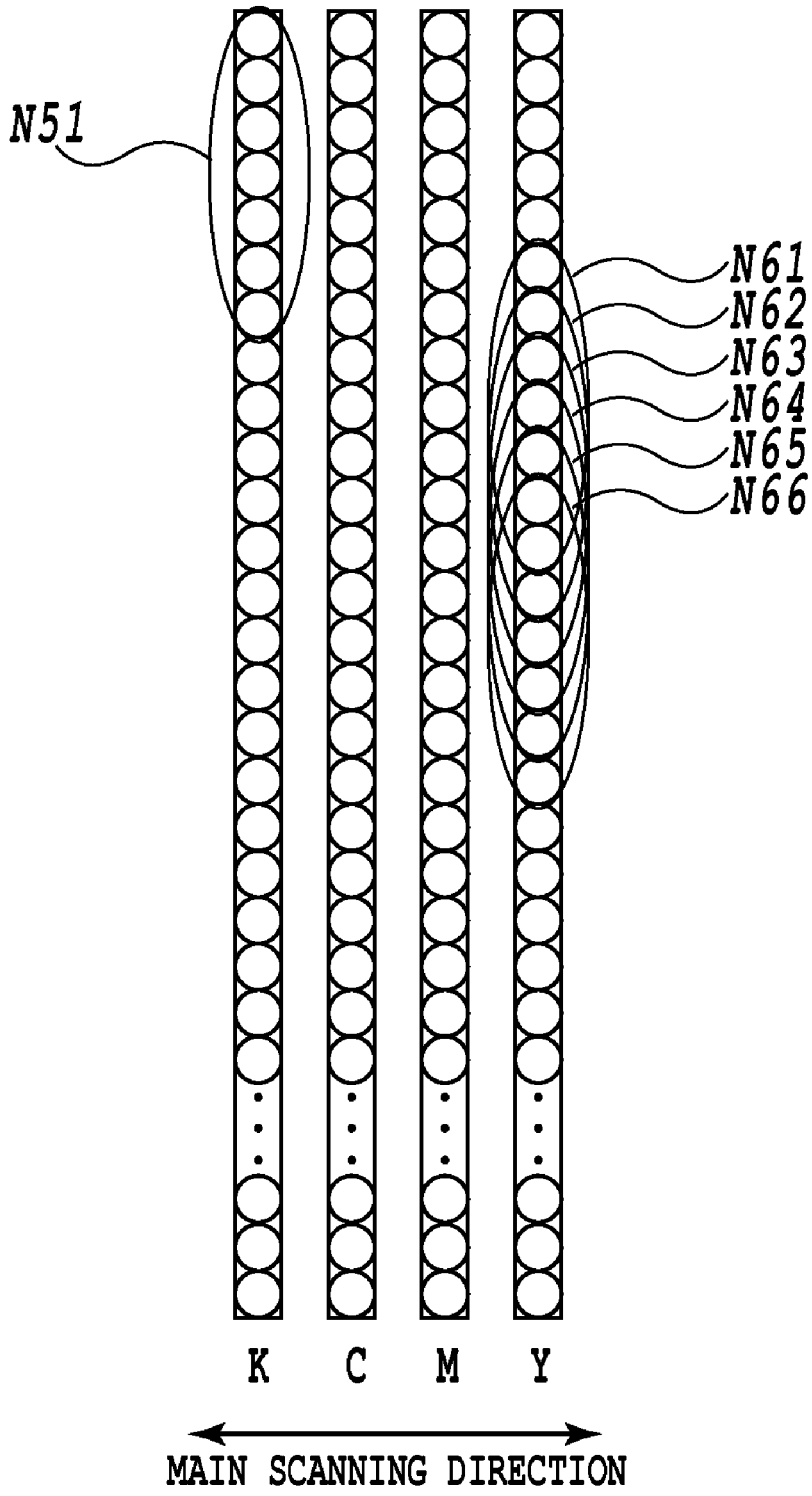
FIG. 19 is a view showing the print head for printing the test pattern as shown in FIG. 18.

FIG. 19 is a view showing the print head for printing the test pattern as shown in FIG. 18. The plural nozzles for each color in the print head for ejecting the ink of each color of K, C, M and Y are arranged vertically to the main scanning direction of the print head.

The printing order of the pattern P21 includes firstly printing the pattern P211 with the nozzles N51 of the print head for ejecting the first ink (e.g., K ink) using the print data D31 in the forward direction, for example. Then, it includes printing the pattern P212 with the nozzles N61 of the print head for ejecting the second ink (e.g., Y ink) using the print data D32 in the same scanning direction.

Then, the printing medium is conveyed, and the pattern P22 is printed. The pattern P22, like the pattern P21, is made by printing based on print data D31 is performed with the nozzles N51 of the print head for ejecting the first ink (e.g., K ink). Subsequently, printing based on data D32 is performed with the nozzles N62 of the print head for ejecting the second ink (e.g., Y ink) in the same scanning direction. By repeating this operation in the following, the patterns P23, P24 and P25 are printed by gradually shifting the nozzles of the head for printing with the second ink in order of N63, N64, N65 and N66.

A user selects the pattern that looks the most uniform band from among the printed patterns shown in FIG. 18. In an example of FIG. 18, the pattern P24 is the most appropriate pattern.

Also, the test pattern may be printed by using the same nozzle and changing the test patterns as in the first another example.

Figure 20:
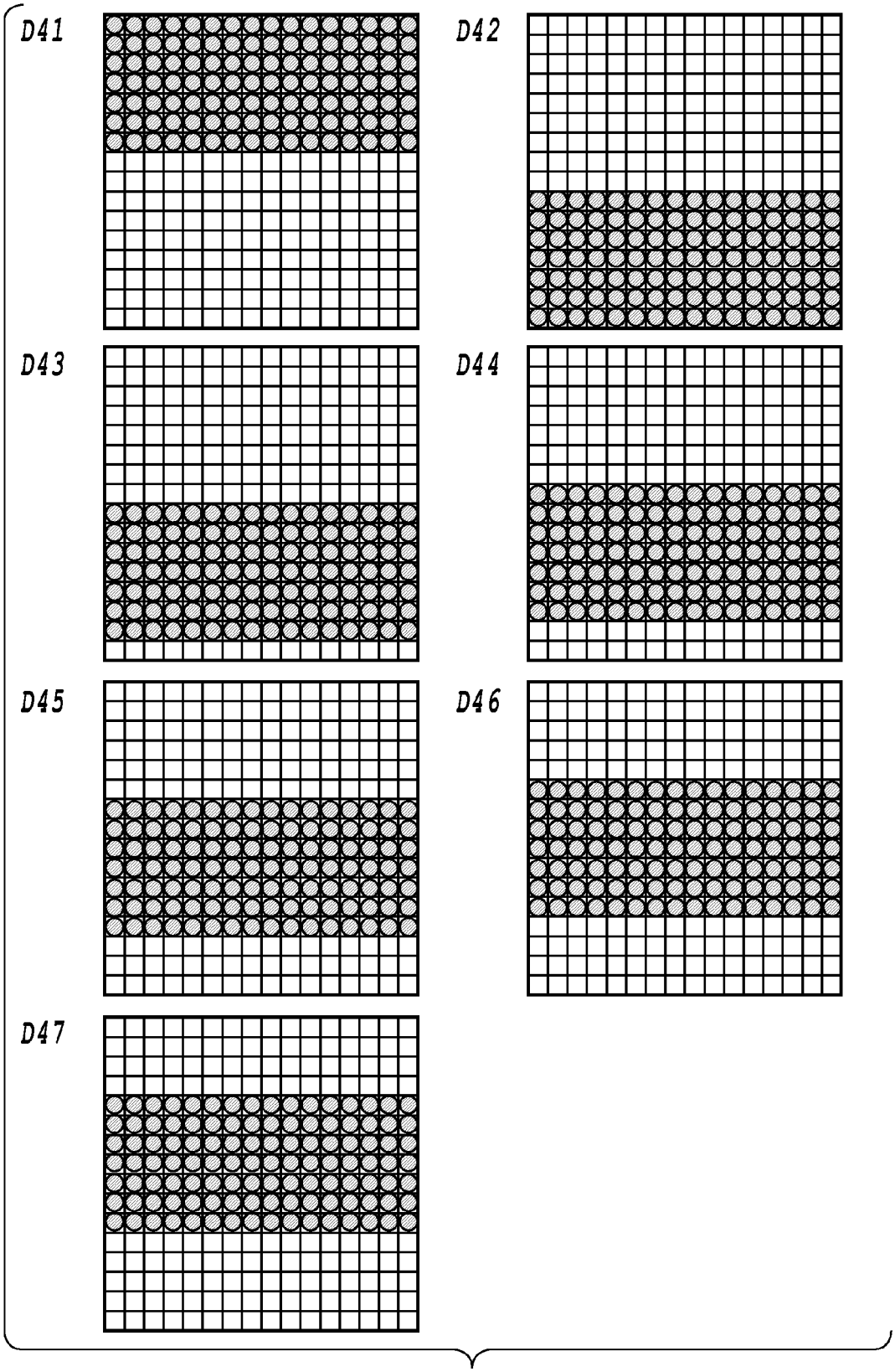
FIG. 20 is a view showing another example of test pattern data.

FIG. 20 is a view showing the test pattern data. In FIG. 20, reference sign D41 denotes the print data to be printed with the first ink, and reference signs D42 to D47 denote the print data to be printed with the second ink. The test pattern printed using the print data of FIG. 20 is shown in FIG. 18. Firstly, the pattern P21 is printed using a part of the plural nozzles in the print head for the first ink and a part of the plural nozzles in the print head for the second ink.

Figure 21:
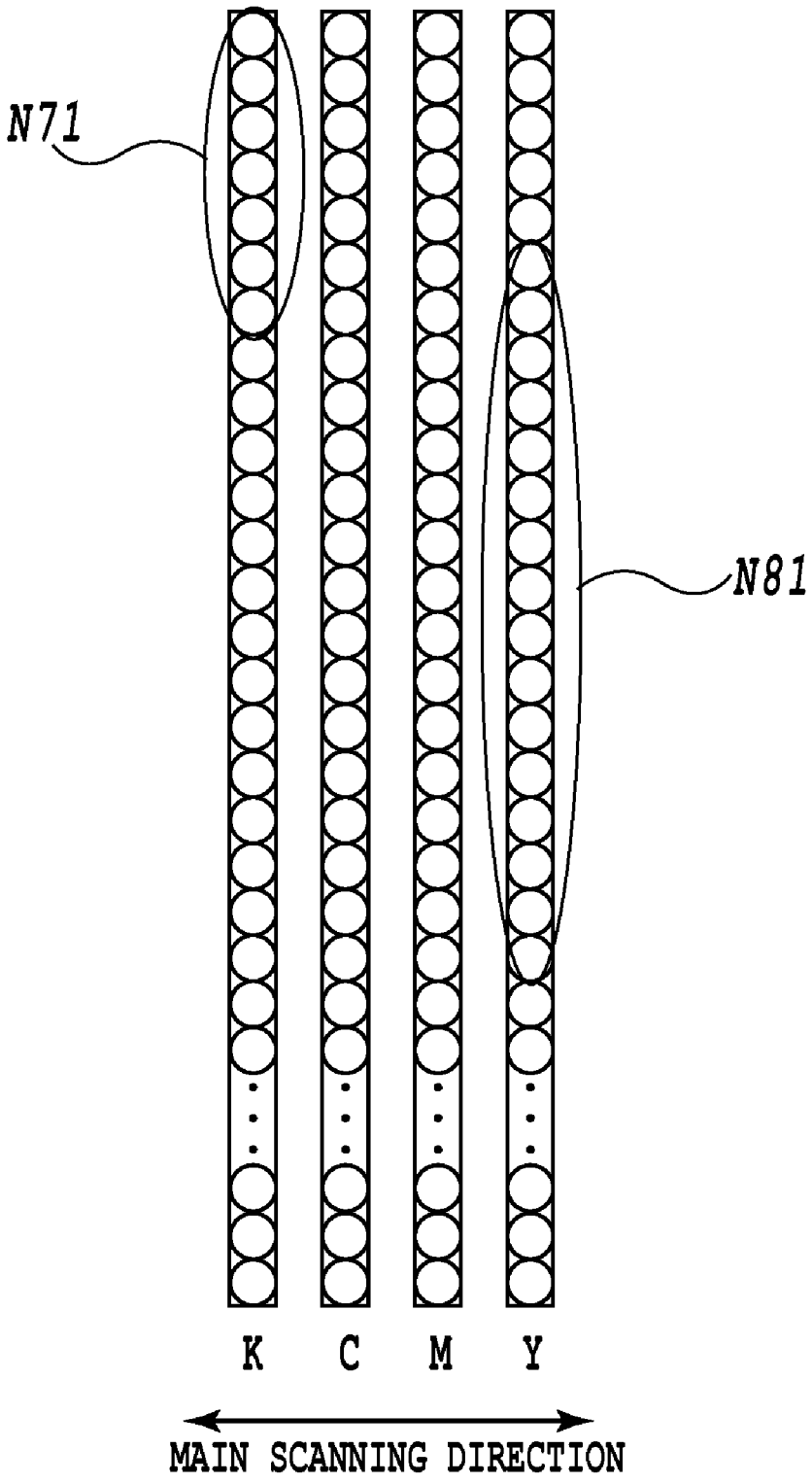
FIG. 21 is a view showing the print head for printing the test pattern based on data of FIG. 20.

FIG. 21 is a view showing the print head for printing the test pattern shown in FIG. 18. The plural nozzles for each color in the head for ejecting the ink of each color of K, C, M and Y are arranged vertically to the main scanning direction of the print heads.

The printing order of the pattern P21 includes firstly printing the pattern P211 with the nozzles N71 of the print head for ejecting the first ink (e.g., K ink) using the print data D41 in the forward direction, for example. Then, it includes printing the pattern P212 with the nozzles N81 of the print head for ejecting the second ink (e.g., Y ink) using the print data D42 in the same scanning direction.

Then, the printing medium is conveyed, and the pattern P22 is printed. The pattern P22, like P21, is made by printing the print data D41 with the nozzles N71 of the print head for ejecting the first ink (e.g., K ink). Subsequently, based on the data D43 printing pattern is performed with the nozzles N81 of the print head for ejecting the second ink (e.g., Y ink) in the same scanning direction. By repeating this operation in the following, the patterns P23, P24 and P25 are printed by the print head for ejecting the second ink by gradually shifting the print data in order of D44, D45, D46 and D47.

In this specification, the printing means not only forming the significant information such as character, graphics and so on, but also widely forming the image, design or pattern by supplying liquid onto the printing medium, and processing the medium.

Also, the "printing medium" means not only the paper for use in the general printing apparatus, but also widely the medium capable of accepting the ink ejected by the print head such as cloth, plastic film or metal plate.

Further, the "ink" should be interpreted broadly in the same way as the definition of the "print", and means the liquid supplied on the printing medium to form the image, design or pattern, or to process the printing medium.

Though in the above embodiment, the liquid droplets ejected from the print head are the ink and the liquid stored within the ink tank is the ink, the stored substance may not be limited to the ink. For example, the ink tank may store a treatment liquid ejected onto the printing medium to improve the fixing property or waterproof of the printed image and the image quality.

Further Embodiment

It should be noted that in the above described embodiments, two types of image processing: image processing performed in each scanning area and image processing performed for each scanning direction are performed. However, it may not be necessary the case that these image processing is performed. Further, the image processing is not limited to the above processing and other image processing in each scanning area may be implemented.

Though the recording heads for ejecting the four color inks of C, M, Y and K are used in the above embodiments, the printing heads may include the head for ejecting the other color ink such as a hypochromic ink or a special color ink. Also, the constitution of the printing head may be integrally provided with the nozzle array for each ink color. Further, though the first ink for reference is K ink in the above embodiment, the recording head (nozzle array) of other color ink may be used as reference.

Also, the test pattern print data may be configured such that data of one dot are arranged in the main scanning direction of the head, and the pattern that looks like one straight line is selected from among the printed test patterns. However, even if the print data is the data of plural dots arranged in the main scanning direction of the head, plural patterns that look like straight line may be selected by performing printing based on the print data in which the data of plural dots is arranged for every plural dots in the main scanning direction.

The invention can be implemented by a program code for realizing the procedure of the flowchart as shown in FIG. 11 or 13 or a storage medium storing it to realize the functions of the above embodiments. Also, the invention can be achieved by the program code stored in the storage medium being read and executed by a system or apparatus computer (or CPU or MPU). In this case, the program code itself read from the storage medium implements the functions of the above embodiments, and the storage medium storing the program code constitutes the invention.

Examples of the storage medium for supplying the program code may include a floppy (registered trademark) disk, a hard disk, an optical disk, an optical magnetic disk, a CD-ROM, a CD-R, a magnetic tape, a non-volatile memory card, and a ROM.

Also, the program code may be not only read and executed by the computer, but also a part or all of the actual process may be performed based on the instructions of the program code by an OS operating on the computer to implement the functions of the above embodiments.

Further, after the program code is written into a memory provided in a function extension board inserted into the computer or a function extension unit connected to the computer, the CPU may perform a part or all of the actual processing, based on instructions of the program code.

Still Another Embodiment

Though the above printing apparatus uses the ink jet method, it will be apparent from the above description that the printing apparatus may not be limited thereto. Also, though the processes of FIGS. 11 and 13 are performed in the printing apparatus in the above embodiment, of course, the invention is not limited to this form. These processes may be performed on the host apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-187394, filed Jul. 18, 2007, which is hereby incorporated by reference herein in its entirety.

What is claimed is:

1. A printing method for printing on a print medium by scanning a print head, provided with a first printing element group and a second printing element group, in a scan direction, each of the first and second printing element groups comprising a respective plurality of printing elements arranged in an array direction intersecting with the scan direction, the method comprising:

a selecting step of selecting:

(i) a first printing operation in which a first range of printing elements, which are part of the first printing element group, are selected for printing, and a second range of printing elements, which are part of the second printing element group and have an equal position to the first range of printing elements in the array direction, are selected for printing, or (ii) a second printing operation in which a position of printing elements of the first printing element group in the array direction, to which data corresponding to the printing elements of the first printing element group is supplied, and a position of printing elements of the second printing element group in the array direction, to which data corresponding to the printing elements of the second printing element group is supplied, are shifted; and a printing step of printing on the print medium in accordance with the selection in the selecting step.

2. A printing method as claimed in claim 1, wherein the first printing operation or the second printing operation is performed in accordance with printing conditions.

3. A printing method as claimed in claim 2, wherein the printing conditions are printing modes, and the first printing operation is performed in the case of a first printing mode, and the second printing operation is performed in the case of a second printing mode, which has a higher driving resolution for the print head than the first printing mode.

4. A printing method as claimed in claim 2, wherein the printing conditions are types of printing media, and the first printing operation is performed in a case where the type of printing medium is a high quality paper, and the second printing operation is performed in a case where the type of printing medium is a plain paper.

5. A printing method as claimed in claim 2, wherein the printing conditions are a deviation amount and a size of an image to be printed, and the first printing operation or the second printing operation is performed, in accordance with the deviation amount and the size of the image to be printed.

6. A printing method as claimed in claim 1, further comprising the step of:

comparing a printing element resolution of the print head in the array direction with a print data resolution in the array direction, wherein if the print data resolution in the array direction is lower than the printing element resolution in the array direction, the first printing operation is selected, and wherein if the print data resolution in the array direction is equal to or higher than the printing element resolution in the array direction, the second printing operation is selected.

7. A printing apparatus for printing on a print medium, comprising:

a print head comprising a first printing element group and a second printing element group and configured to scan in a scan direction, each of the first and second printing element groups comprising a respective plurality of printing elements arranged in an array direction intersecting with the scan direction; and a selecting unit configured to select:

(i) a first printing operation in which a first range of printing elements, which are part of the first printing element group, are selected for printing, and a second range of printing elements, which are part of the second printing element group and have an equal position to the first range of printing elements in the array direction, are selected for printing, or (ii) a second printing operation in which a position of printing elements of the first printing element group in the array direction, to which data corresponding to the printing elements of the first printing element group is supplied, and a position of printing elements of the second printing element group in the array direction, to which data corresponding to the printing elements of the second printing element group is supplied, are shifted, wherein the print head is configured to print in accordance with a selection by the selecting unit.

8. A printing apparatus as claimed in claim 7, wherein the first printing operation or the second printing operation is performed in accordance with printing conditions.

9. A printing apparatus as claimed in claim 8, wherein the printing conditions are printing modes, and the first printing operation is performed in the case of a first printing mode, and the second printing operation is performed in the case of a second printing mode, which has a higher driving resolution for the print head than the first printing mode.

10. A printing apparatus as claimed in claim 8, wherein the printing conditions are types of printing media, and the first printing operation is performed in a case where the type of printing medium is a high quality paper, and the second printing operation is performed in a case where the type of printing medium is a plain paper.

11. A printing apparatus as claimed in claim 8, wherein the printing conditions are a deviation amount and a size of an image to be printed, and the first printing operation or the second printing operation is performed, in accordance with the deviation amount and the size of the image to be printed.

12. A printing apparatus as claimed in claim 7, further comprising:

a comparing unit configured to compare a printing element resolution of the print head in the array direction with a print data resolution in the array direction, wherein if the print data resolution in the array direction is lower than the printing element resolution in the array direction, the first printing operation is selected by the selecting unit, and wherein if the print data resolution in the array direction is equal to or higher than the printing element resolution in the array direction, the second printing operation is selected.

13. A printing method as claimed in claim 1, further comprising:

an obtaining step of obtaining information on an adjustment amount of a printing position on the print medium by the first printing element group and a printing position on the print medium by the second printing element group; and a determining step of determining the first range of printing elements in the first printing operation and the number of pixels corresponding to an amount of the shift in the second printing operation, based on the information on the adjustment amount.

14. A printing method as claimed in claim 13, further comprising:

a printing step of printing a pattern for obtaining the information on the adjustment amount by using the first printing element group and the second printing element group, wherein the obtaining step obtains the information on the adjustment amount, based on the pattern.

15. A printing apparatus as claimed in claim 7, further comprising:

a obtaining unit configured to obtain information on an adjustment amount of a printing position on the print medium by the first printing element group and a printing position on the print medium by the second printing element group; and a determining unit configured to determine the first range of printing elements in the first printing operation and the number of pixels corresponding to an amount of the shift in the second printing operation, based on the information on the adjustment amount.

16. A printing apparatus as claimed in claim 15, wherein the print head prints a pattern for obtaining the information on the adjustment amount by using the first printing element group and the second printing element group, and wherein the obtaining unit obtains the information on the adjustment amount, based on the pattern.

* * * * *